US006257136B1

(12) United States Patent
McCoy et al.

(10) Patent No.: US 6,257,136 B1
(45) Date of Patent: Jul. 10, 2001

(54) REGISTRATION CONTROL FOR QUALITY SILK SCREEN PRINTING

(75) Inventors: Gary W. McCoy, Butler; John M. Zwigart, New Brighton; Carl J. Strutz, Mars; Mark R. Tweedy, Valencia, all of PA (US)

(73) Assignee: Carl Strutz & Co., Inc., Mars, PA (US)

( * ) Notice: Subject to any disclaimer, the term of this patent is extended or adjusted under 35 U.S.C. 154(b) by 0 days.

(21) Appl. No.: 09/393,179

(22) Filed: Sep. 9, 1999

(51) Int. Cl.[7] ..... B41F 15/12; B41F 15/30
(52) U.S. Cl. ..... 101/38.1; 101/124; 101/129
(58) Field of Search ..... 101/38.1, 39, 40, 101/40.1, 115, 123, 124, 126, 129

(56) References Cited

U.S. PATENT DOCUMENTS

| | | | | |
|---|---|---|---|---|
| 2,231,535 | | 2/1941 | Jackson et al. . | |
| 2,261,255 | | 11/1941 | Jackson . | |
| 2,721,516 | | 10/1955 | Campbell et al. . | |
| 3,146,705 | | 9/1964 | Ritzerfeld et al. . | |
| 3,251,298 | | 5/1966 | Rudolph et al. . | |
| 3,338,574 | | 8/1967 | Rudolph et al. . | |
| 5,471,924 | * | 12/1995 | Helling | 101/38.1 |
| 5,524,535 | | 6/1996 | Strutz et al. . | |
| 5,553,547 | * | 9/1996 | Miller | 101/485 |
| 5,857,409 | * | 1/1999 | Derrickson | 101/38.1 |

* cited by examiner

*Primary Examiner*—Ren Yan
(74) *Attorney, Agent, or Firm*—Clifford A. Poff

(57) ABSTRACT

Workpiece rotators are constructed for decoration registration control in spaced apart decoration stations for bottles rotatably supported by carriers of an endless chain conveyor. A screen drive at each decorating station linearly reciprocates a decorating screen to decorate the bottle. A squeegee is positioned to maintain line contact between the decorating screen and a bottle for applying decoration during each screening cycle. The workpiece rotator is coupled by a drive controller to the screen drive to rotate a bottle synchronously with linear travel of the decorating screen. The drive controller uncouples the workpiece rotator from the screen drive at times other than the application of decoration to a bottle. In one embodiment electronic gearing is formed by a servo motor controlled by a scale moved by a screen drive along a detector head which provides an electrical signal used in a control system to maintain proper position of the servo motor during decoration, to re-home the rotator after decoration and to establish a predetermined power start-up position for the rotator. The vertical position of the rotator is adjusted for coaxial alignment between the rotational axes of the rotator and the workpiece. The drive for the rotator may include a one-way clutch or an electric clutch and brake driven by a pinion controlled by a rack in response to reciprocation of the screen drive.

61 Claims, 33 Drawing Sheets

REGISTRATION CONTROL FOR QUALITY SILK SCREEN PRINTING

BACKGROUND OF THE INVENTION

1. Field of the Invention

The present invention relates to an improved registration control in an intermittent motion type decorating machine for increasing the quality of printed indicia and precision of indicia registration on a workpiece and, more particularly, to improving the interrelationship and construction of drive components used for synchronously moving a decorating screen and a workpiece to apply decoration to workpieces especially to avoid registration errors in the placement of multicolor decorations in a given decoration area of a workpiece.

2. Description of the Prior Art

As shown in U.S. Pat. Nos. 2,231,535; 2,261,255; 2,721,516; 3,251,298; and 5,524,535 intermittent motion type decorating machines are known in the art and provide an indexing drive system to impart intermittent traveling motion to an endless chain conveyor used to supply workpieces such as containers made of glass or plastic. A container is moved by the endless chain conveyor through a predetermined distance, stopped, moved again through a predetermined distance, stopped and again moved until each container through the sequence of motions moves completely through each of all of the decorating stations of the decorating machine. A decorating station is provided at one or more places along the conveyor. A decorating screen is displaced by an associated squeegee into line contact with the surface of the container while the container is stopped from traveling motion and the container is rotated about a longitudinal axis thereof During the decorating process a synchronous speed relation must be maintained between the linear displacement of the screen and the peripheral speed of the rotating container at the line of contact established by the squeegee. The squeegee remains stationary during the decorating process. Decorating machines of this type are particularly useful to decorate bottles and carryout the decoration while the surface of the bottle being decorated is horizontally oriented.

In the above U.S. Pat. No. 2,261,255 there is disclosed a drive for moving each of a body screen to decorate a cylindrical body of a bottle and a shoulder screen to decorate a tapered or straight neck portion of the bottle at the corresponding peripheral and linear speeds. The decorating machine disclosed in the aforesaid U.S. Pat. No. 3,251,298, provided a production rate of about 125 bottles per minute. The decoration is carried out by dividing a machine cycle into two decoration cycles, each essentially made up of two equal parts. One half each decoration cycle is used for the decoration of a workpiece and the remaining half the decoration cycle is used for indexing movement of the bottles by the conveyor through the decorating machine. There is no overlap between the decorating and indexing cycles. During the first part of the decoration cycle, the decoration screen is moved along a linear path in only one direction at a speed that is synchronous with the peripheral speed of the decoration receiving surface of the rotating bottle to avoid smearing the printing media. The drive for the entire decorator is powered by a single motor to synchronize the operation by various drive trains to maintain a timed sequence at synchronous speed of operation by a screen drive and a bottle rotator. When the decoration screen moves to the end of its linear path of travel, the bottle rotator completes a rotation cycle of 360°. The second part of the decoration cycle, powered by the drive motor, provides that the screen drive enters a dwell period to maintain the decoration screen stationary for the remaining part of the decoration cycle while the decorated bottle is removed from the decorating station and an undecorated bottle is installed at the decorating station. The newly installed bottle at the decorating station is decorated by the same timed sequence of operation in the second decorating cycle of the machine cycle. Important, however, is the fact that the operation of the same decorating screen in the second decorating cycle is accomplished by reversing the linear travel of the decorating screen by providing a continuous cam track of a rotating cam used to drive the decorating screen in a reverse direction of screen travel for decoration of a workpiece in the second decorating cycle of the machine cycle. This reversal to the direction of screen travel necessarily requires the drive elements transmitting torque between the screen drive cam and the decorating screen to pass from one state of torque transmitting, and metal-to-metal relationship through necessary operating clearances in the drive train and into a different state of torque transmitting, metal-to-metal relationship during displacement of the decorating screen in the reverse direction of travel. The machine cycle uses a preestablished position relationship between the decoration site on the bottle surface and the pattern of decoration in the decorating screen. This preestablished position relationship is created by providing a registration station at the entry end of the workpiece conveyor for rotating each bottle about the longitudinal axis of the bottle into a preestablished orientation in a bottle carrier that is part of the workpiece conveyor of the decorating machine.

In U.S. Pat. No. 3,338,574, there is shown a workpiece carrier device for supporting a bottle in a horizontal orientation while intermittently moved along a path of travel through a decorating apparatus. The bottle is supported at its opposite ends by clamping chucks one of which has a journal extending from a bearing support and the other of which can move releasably to contact a bottle for causing rotation about a horizontal axis. The bottle is rotated by a drive member brought into a driving relation with the protruding journal part of the bearing support. The clamping chucks are operatively supported on a base secured to chain-links forming an endless conveyor chain extending along the path of travel of bottles through the decorating apparatus.

Robustly constructed drives are necessary to withstand the forces of inertia and impact loading which occur due to the intermittent conveyor motion moving the bottles to and from each of the decorating stations, the rotation of each bottle for the decorating process and the drive mechanism for reciprocating each decorating screen at each decorating station. More recently as disclosed in U.S. Pat. No. 5,524,535 an improved intermittent decorating machine cycle is provided to increase the rate for decorating bottles. Two decorating cycles making up a machine cycle are each provide that during the decoration cycle a portion for conveyor indexing has a reduced duration to provide an increase to the duration of the decoration cycle in which the screen is linear displaced while the bottle is rotated for decoration.

In such intermittent motion decorating machines, thermosetting ink is usually the printing medium particularly when multiple color decoration is needed. Ink of only one color is applied at each decorating station and to decorate with multiple colors requires corresponding multiple decoration stations. When the different colors interleave in a given area of the bottle, the same area is contacted with the screens for each color and therefore it is necessary that the applied ink/color is solidified and will not smear when additional ink/color is applied. Although the ink is solidified after each printing operation, curing the ink by feeding the bottles through a furnace after discharging from the decorating machine is necessary. In co-pending patent application Ser. No. 09/079,753 filed May 15, 1998 there is disclosed an intermittent decorating machine providing curing of ink decoration applied at one station before additional decoration is applied so that the decoration on a bottle delivered from the decoration machine is cured and the bottle can be loaded directly into a shipping container without the need for curing the ink decoration. The decorating medium cures very rapidly when exposed to electromagnetic wave energy such as ultraviolet radiation or heat. Curing stations are interleaved between printing stations and a drive to rotate a bottle at a printing station is linked with a drive to rotate a bottle at a curing station for exposing uncured printing medium to the electromagnetic wave or heat to curing the printing medium. The dwell period of the intermittent advancing motion by the conveyor chain is used to apply decoration and to cure the applied decoration all at difference spaced apart sites along travel by the bottles in the decorating machine.

At each decorating station there is a rotator drive head provided with a slot opening to receive a roller on the end of a crank arm by which a bottle is rotated for the decorating process. The rotational axis of the bottle and the rotational axis of the drive head must be aligned to produce a uniform rotational speed of the bottle surface to which decoration is applied. As each bottle carrier is advanced by the chain conveyor to a decoration station, rollers that are part of each of the parallel runs of chain are displaced vertically from the horizontal path of travel by carrier riser cams. The bottle on the carrier is lifted, a relatively small but sufficient distance, to avoid impact by the decorating screen during its necessary reciprocating movement with bottles on adjacently located carriers. Wear of the chain rollers and the riser cams cause a change to the preset elevation of the carrier at the decorating station which in turn fails to bring the rotation axis of the bottle into coaxial alignment with the rotation axis of the bottle rotator. This lack of coaxial alignment produces nonconcentric rotation between the rotational axis of the bottle and the rotator. As a result, the applied decoration is distorted because of slippage due to the mismatch of speeds between the decorating screens and the rotation of the bottle surface.

Other factors have an adverse influence to the elevation at which bottles are delivered by the conveyor for a dwell period for decoration at a printing station. One such factor is dimensional variations occurring during the manufacture of "L" shaped lugs of which three and sometimes four such lugs are used to mount bottle carriers to conveyor chains of the conveyor. The dimensional variations occur randomly as errors to the drilled location of apertures in "L" shaped lugs and variations to the precision of bending bar stock to the required "L" shaped configuration. Another factor is backlash between meshing gear teeth of a drive gear mounted on the bottle rotator and a gear rack reciprocated in response to reciprocation of the decorating screen. The backlash can be eliminated through periodic adjustments to the elevation of the gear rack but are made periodically to correct for an unacceptable mismatch of speeds between the reciprocation of the decorating screen and rotation of the bottle surface. This backlash also adversely affects the start and stop location of the bottle rotator.

One aspect of the present invention is particularly useful for controlling intermittent motion decorating machines constructed to apply decoration in each of opposite directions of reciprocation by a decorating screen. There are significant disadvantages to the existence of a continuous mechanical interlocking relation formed by the meshing relationship between the drive gear mounted on the bottle rotator and the meshing gear rack driven through a mechanically connected drive to reciprocate with reciprocation of the decorating screen. The mechanical interlocking relation adversely effects the precision with which decoration is applied to designated decoration areas of successive bottles. A first relationship is established between the screen and a decoration area of the receiving bottle after all operating clearances of the bottle rotator and screen reciprocating drive are eliminated by a metal-to-metal relation for transmitting torque. A second relation is established which differs from the first relation as a result of the aggregate of the operating clearances traversed by the machine parts in the drive system when reversed to displace the screen in a return direction linearly. When the direction of screen displacement is reversed from the return direction there is a return to the first relationship because the screen drive is mechanically coupled continuously to the gear rack system of the bottle rotator. A feature of the present invention provides for the decoration of successive bottles by a decorating screen only when the screen is linearly displaced in the same direction and when the travel of the screen is reversed the bottle rotator is uncoupled from the driving relationship with the screen drive to prevent impact between the crank arm of a bottle carrier entering the decorating station with the rotator. By avoiding the reversing revolution of the rotator, the drive slot is at an orientation or can be correctively positioned to a required orientation for receiving a crank arm of a bottle support for the next bottle entering the decorating station.

It is an object of the present invention to provide an improved construction and operation for an intermittent motion decorator having a workpiece rotator coupled by a drive controller to a screen drive used to linearly displace a decorating screen synchronously with rotation of a workpiece and after the application of decoration, the drive controller is operable to uncouple the rotator from the screen drive.

It is a further object of the present invention to provide an intermittent motion decorator having at least two decorating stations separated by a distance along which guides maintain orientation of workpiece crank arms used to prevent the loss of workpiece orientation during the indexing and rotate a workpiece at each decorating station after mechanically coupled to a rotator driven by an electric motor controlled by an electronic linear motion detector responsive to displacement of a decorating screen when applying decoration to the workpiece.

It is another object of the present invention to provide an intermittent motion decorator embodying a drive operatively controlled to rotate a workpiece for the application of decoration only during displacement of a decorating screen in one direction and not in the second reversing direction during which a successive workpiece is advanced by intermittent motion to the decorating station and the workpiece rotator is non responsive to the return of the decorating screen.

It is another object of the present invention to provide an intermittent motion decorator having the workpiece rotator driven by an electric motor controlled for intermittent operation only during the application of decoration, the workpiece rotator being vertically movable for accommodating changes to the elevation at which the rotational axis of a workpiece rotator resides at a decorating station during operation of the workpiece rotator.

It is yet a further object of the present invention to provide an electric control system for correcting position error of a workpiece rotator after decorating a first workpiece to insure a driving relation established with a second workpiece in an intermittent motion decorator to faithfully maintain both workpiece orientation and synchronous speed relation between linear displacement of a decorating screen and surface speed of a rotating workpiece, particularly in intermittent motion decorator machines having a decorator drive cam constructed for unidirectional decorating.

SUMMARY OF THE INVENTION

According to the present invention there is provided an apparatus for decorating workpieces, the apparatus including the combination of a conveyor having successively arranged workpiece supports to carry workpieces for rotation about longitudinal axes of the workpieces, an intermittent motion decorator having at least one decorating station including a screen drive operative to linearly reciprocate a decorating screen to provide at least one screen cycle for decorating a resident workpiece at the decorating station, the decorating station further including a squeegee moveable to an operative position to maintaining line contact between the decorating screen and a resident workpiece for applying decoration to a resident workpiece during the screen cycle, a drive coupled to the conveyor for intermittently advancing workpieces supported by the workpiece supports to the decorating station, the drive being operative to maintain a workpiece at the decorating station during a workpiece dwell period for decorating a resident workpiece at the intermittent decorating station, and a workpiece rotator coupled by a drive controller to the screen drive to rotate a decoration receiving surface of a resident workpiece synchronously with linear travel of the decorating screen during the screen cycle, the drive controller being operable to uncouple the workpiece rotator from the screen drive at times other than the applying decoration to a resident workpiece during the screen cycle.

The invention further provides an apparatus for decorating workpieces, the apparatus including the combination of a conveyor having successive workpiece support carriers each including spaced apart chucks for supporting a workpiece, a crank arm extending to one side of the conveyor from one chuck of each of the workpiece support carriers for rotating the workpiece supported thereby about a longitudinal axis of the workpiece, an intermittent motion decorator having at least two decorating stations each including a) a screen drive operative to linearly reciprocate a decorating screen to provide a screen cycle for decorating successive resident workpieces at the decorating station, b) a squeegee moveable to an operative position to maintaining line contact between the decorating screen and each of successive resident workpieces for applying decoration to resident workpieces during each linear reciprocation by the decorating screen, c) an electronic linear motion detector for generating an electrical signal corresponding to displacement of the decorating screen in each direction of linear reciprocation of the decorating screen, a workpiece rotator including an electric motor controlled in response to the electrical signal for rotating a decoration receiving surface of a resident workpiece at a synchronous speed relation with linear reciprocation of the decorating screen, and d) a drive coupled to the conveyor for intermittently advancing workpieces supported by the workpiece support carriers to each of the decorating stations, the drive being operative to maintaining a workpiece at each of the decorating stations during a workpiece dwell period for decorating resident workpieces at the decorating stations, and vertically spaced guide bars forming a crank arm guide path extending between the at least two decorating stations for receiving and maintaining the orientation of the crank arm extending from each of the workpiece support carriers advanced by the conveyor from one of the decorating stations to the other of the decorating stations.

According to the present invention there is also provided an apparatus for unidirectional decoration of workpieces, the apparatus including the combination of a first drive for intermittently advancing first and second spaced apart workpieces along a course of travel containing a decorating station at which each workpiece intermittently ceases advancing movement during decoration of a workpiece surface, a second drive for displacing a decorating screen along a linear path of travel in a printing direction for decorating a workpiece and along the linear path of travel in a reverse direction to the printing direction for returning the decorating screen to a position for initiating displacement in the printing direction for decorating a second workpiece, a third drive drivenly controlled by the second drive for rotating each of the first and second workpieces indexed in succession into the decorating station only in response to movement of the decorating screen in the printing direction to apply decoration to each of the workpieces, the third drive being non responsive to return of the decorating screen in the linear path of travel in a reverse direction, and a fourth drive for displacing a squeegee for pressing the decorating screen into line contact with a workpiece for decoration thereof.

The apparatus of the present invention is useful to provide a method for decorating workpieces advanced to and from a decorating station, the method including the steps of advancing a first workpiece to intermittently reside at a decorating station, establishing a drivenly coupled relation between a workpiece rotator and a screen drive to form a synchronous speed relation between linear displacement of a decorating screen in a first direction from a screen start position between a squeegee and a decoration surface of a first workpiece during rotation of the first workpiece in a decoration cycle by a workpiece rotator from a rotator start position, commencing the application of a decoration by the decorating screen to the decoration surface of the first workpiece while maintaining the synchronous speed relation, concluding the application of decoration on the first workpiece with the decorating screen displaced distant to the screen start position and the workpiece rotator is rotated to, at least proximate, the rotator start position of the workpiece rotator, discontinuing the drivenly coupled relation between the workpiece rotator and the screen drive, correcting position error between the rotated rotator position and the rotator start position, linearly displacing the decorating screen in a second direction opposite to the first direction into the screen start position, and establishing the synchronous speed relation between the decorating screen and a decoration surface of a second workpiece for the application of decoration to the second workpiece.

The method of the present invention also provides for unidirectional decorating of workpieces advanced intermittently to and from a decorating station, the method including the steps of intermittently advancing spaced apart workpieces along a course of travel containing at least two spaced apart decorating stations, using workpiece crank arms each drivenly engaged with one workpiece to maintain a workpiece registration along the course of travel between each workpiece and a decorating screen at each decorating station, and decorating each workpiece at each decoration station by a) applying decoration to a first workpiece during a decorating cycle within a machine cycle, the decorating cycle including linear displacement of a decorating screen in one direction between a squeegee and the first workpiece residing at a decorating station and drivenly coupled to a workpiece rotator interconnected in a drive relation with the decorating screen to maintain a synchronous speed relation with a peripheral speed of a decoration surface of the first workpiece, b) removing the decorated first workpiece from the decorating station, c) returning the decorating screen in a direction opposite of the one direction during a screen return cycle of the machine cycle, d) interrupting the interconnected drive relation between the decorating screen and the workpiece rotator during the step of returning the decorating screen, e) introducing a second workpiece to the decorating station during a screen return cycle of the machine cycle, f) reestablishing the interconnected drive relation between the decorating screen and the workpiece rotator for forming a synchronous surface speed relation between the decorating screen and the speed of an annular surface of a second workpiece, and g) applying decoration to the second workpiece during the decorating cycle within a machine cycle.

The method of the present invention may be practiced by the steps of intermittently advancing spaced apart workpieces along a course of travel containing at least two spaced apart decorating stations, using workpiece crank arms each drivenly engaged with one workpiece to maintain a workpiece registration along the course of travel between each workpiece and a decorating screen at each decorating station, and decorating each workpiece at each decoration station by a) applying decoration to a first workpiece during a first of two decorating cycles within a machine cycle, the first decorating cycle including linearly displacing a decorating screen along a path of travel in one direction between a squeegee and the first workpiece residing at the decorating station, b) producing an electrical signal corresponding to linear displacement of the decorating screen along the path of travel at the decorating station, c) controlling an electric motor having a workpiece rotator mechanically engaged with an associated crank arm to rotate the first workpiece about an axis lying in a first plane containing the squeegee in response to the electrical signal to maintain a synchronous speed relation between the peripheral speed of a decoration surface of the first workpiece and the linear speed of the decorating screen, d) drawing a printing medium from the decorating screen onto the annular surface of the first workpiece along the line of contact formed by the squeegee, e) positioning a second workpiece at the decoration station, f) applying decoration to the second workpiece during the second of two decorating cycles within a machine cycle, the second decorating cycle including linearly displacing a decorating screen along the path of opposite linear travel between a squeegee and the second workpiece residing at the decorating station, g) producing an electrical signal corresponding to linear displacement of the decorating screen along the path of opposite linear travel at the decorating station, h) controlling the electric motor having the workpiece rotator mechanically engaged with an associated crank arm to rotate the second workpiece about an axis lying in a first plane containing the squeegee in response to the electrical signal to maintain a synchronous speed relation between the peripheral speed of a decoration surface of the second workpiece and the linear speed of the decorating screen, and i) drawing a printing medium from the decorating screen onto the annular surface of the second workpiece along the line of contact formed by the squeegee for applying decoration to the second workpiece during a second decorating cycle within the machine cycle.

BRIEF DESCRIPTION OF THE DRAWINGS

The present invention will be more fully understood when the following description is read in light of the accompanying drawings in which.

DETAILED DESCRIPTION OF THE EMBODIMENT OF THE INVENTION

Figure 1:
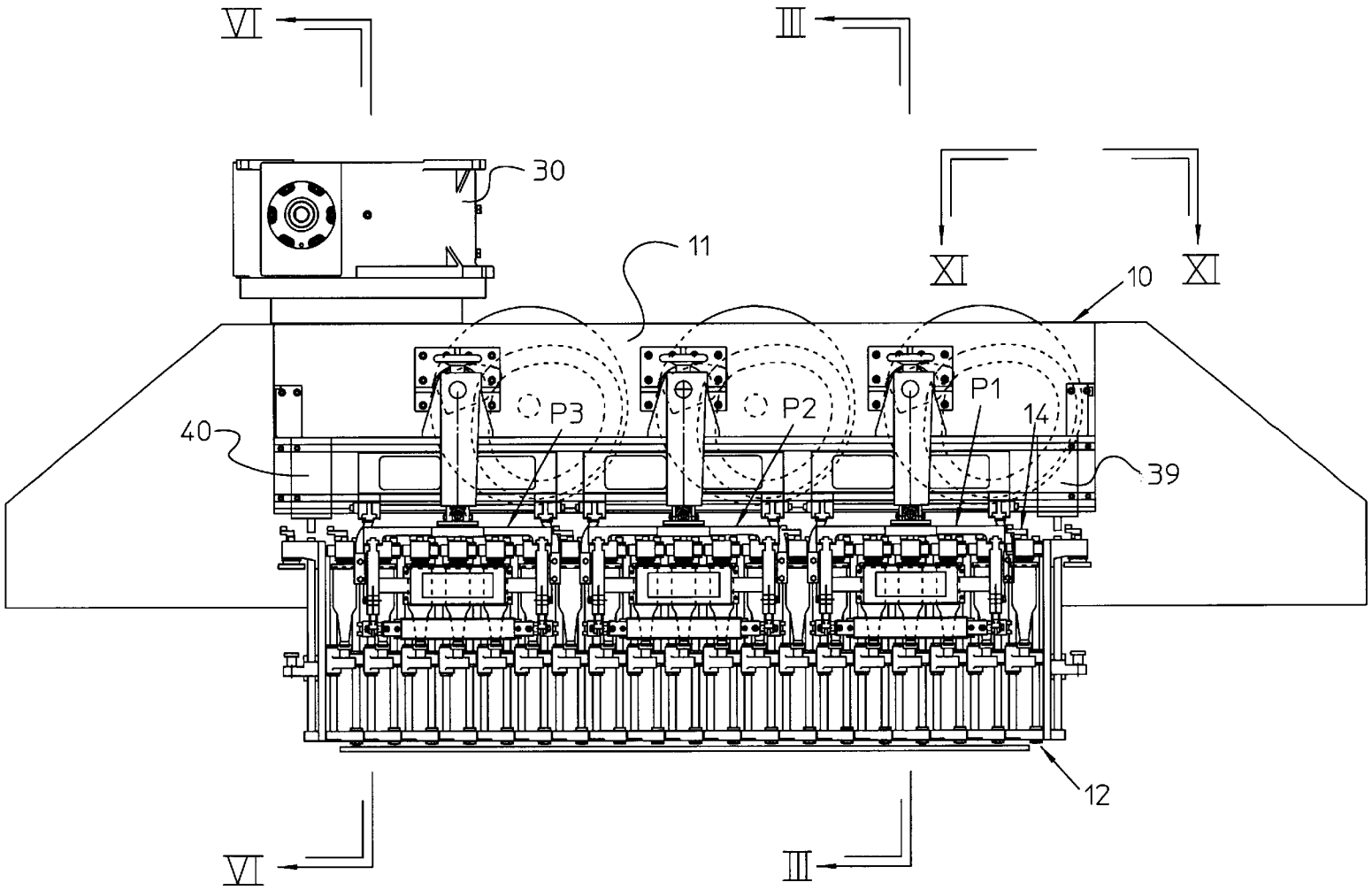
FIG. 1 is a plan view of a decorating machine according to a first embodiment of the present invention.

Referring now to FIGS. 1–6 of the drawings, there is illustrated a decorating machine 10 according to the present invention which comprises a base 11 for supporting an endless chain conveyor 12 for conveying workpieces which, for describing the preferred embodiment of the present invention, consist of bottles. The features and advantages of the present invention are equally useful for decorating ware of any of a variety of configurations. The conveyor receives bottles from bottle loading equipment 13 and advances the bottles by intermittent motion to a registration station 14 and thence to three successively arranged and spaced apart decorating stations P1, P2 and P3. It is understood that more than three or less than three decorating stations maybe incorporated in the decorating machine without departing from the present invention. The bottles are advanced from the last decorating station P3 to bottle unloading equipment 15.

Figure 6:
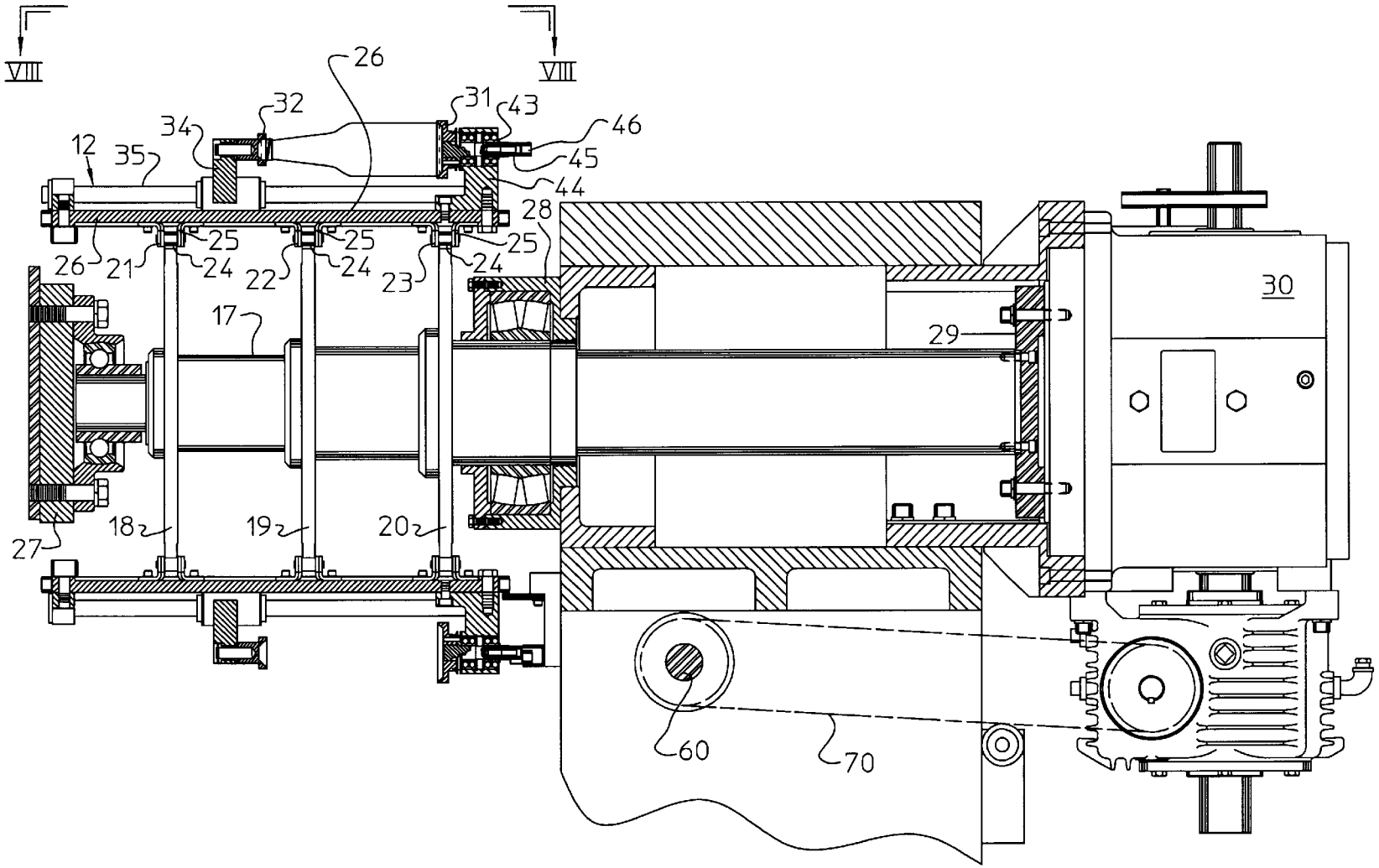
FIG. 6 is a sectional view taken along lines VI—VI of FIG. 1.

As shown in FIGS. 2, 4, 6 and 7, the conveyor 12 includes a support shaft 16 at the entry end of the conveyor and a drive shaft 17 at the delivery end of the conveyor. Support shaft 16 is supported by a spring tensioning assembly 16A carried by the base II to maintain a preselected tension applied by assembly 16A to the sprockets 18A, 19A and 20A and then to the endless chains 21, 22 and 23. Drive shaft 17 is drivenly engaged with coaxially aligned and spaced apart drive sprockets 18, 19 and 20 to drive the runs of endless chains 21, 22 and 23. Links 24 of the endless chains are interconnected by one of three lugs 25 protruding from the bottom of each carrier plate 26 of a plurality of workpiece carriers. The drive shaft 17 is rotatably supported by an outboard bearing support 27 mounted on a sidewall of base 11 and at the inboard side, the drive shaft 17 is supported by an inboard bearing support 28 mounted on a part of the base 11. Drive shaft 17 has an extended shaft portion extending beyond the inboard bearing support 28 to a drive output member 29 of a conveyor index box 30. As best shown in FIG. 6, the drive output member 29 of the index box imparts intermittent rotation to the shaft 17 which in turn imparts intermittent advancing motion to the workpiece carrier mounted on the conveyor 12, thus intermittently advancing bottles along the decorating machine. The bottles are supported in a horizontal orientation between a base cup 31 and a mouthpiece 32 provided on each of the plurality of carrier plates 26 of workpiece carriers.

Figure 8:
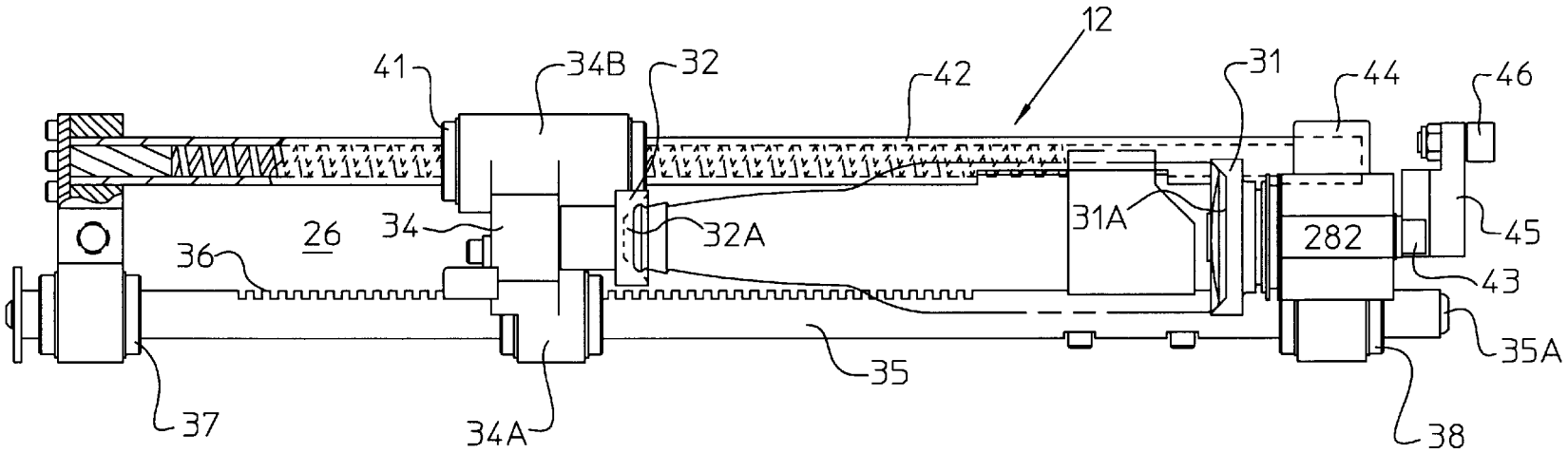
FIG. 8 is a plan view taken along lines VIII—VIII of FIG. 6.

As shown in FIGS. 6 and 8, base cup 31 has a shallow support surface 31A surrounded by a protruding beveled edge to receive and center the base section of the bottle. Mouthpiece 32 has a shallow support surface 32A surrounded by a protruding beveled edge to receive and center the mouth of the bottle. Mouthpiece 32 is rotatably supported by neck chuck 34 having diverging support legs 34A and 34B. Leg 34A is selectively positionable along an actuating shaft 35 having teeth 36 for engaging a releasable latch to allow clamped positioning of the mouthpiece 32 relative to the base cup 31 at any of diverse sites to adapt to a particular height of a bottle between the base cup and mouthpiece. The actuating shaft 35 is slidably supported by spaced apart linear bearings 37 and 38 mounted on the carrier plate 26. An end portion 35A of shaft 35 protrudes from the bearing 38 adjacent the base cup 31 for contact with a clamping actuator assembly 39 at the bottle entry site (FIGS. 1 and 2) where the bottle is received by the conveyor 12. At the bottle discharge site a clamping actuator assembly 40 releases the bottle from the bottle carrier of the conveyor. Returning to FIGS. 6 and 8, the leg 34B of the neck chuck is provided with a linear bearing support block 41 resiliently supported by a support shaft 42 in the same manner as disclosed in U.S. Pat. No. 3,338,574 whose disclosure is incorporated herein by this reference thereto.

Figure 4:
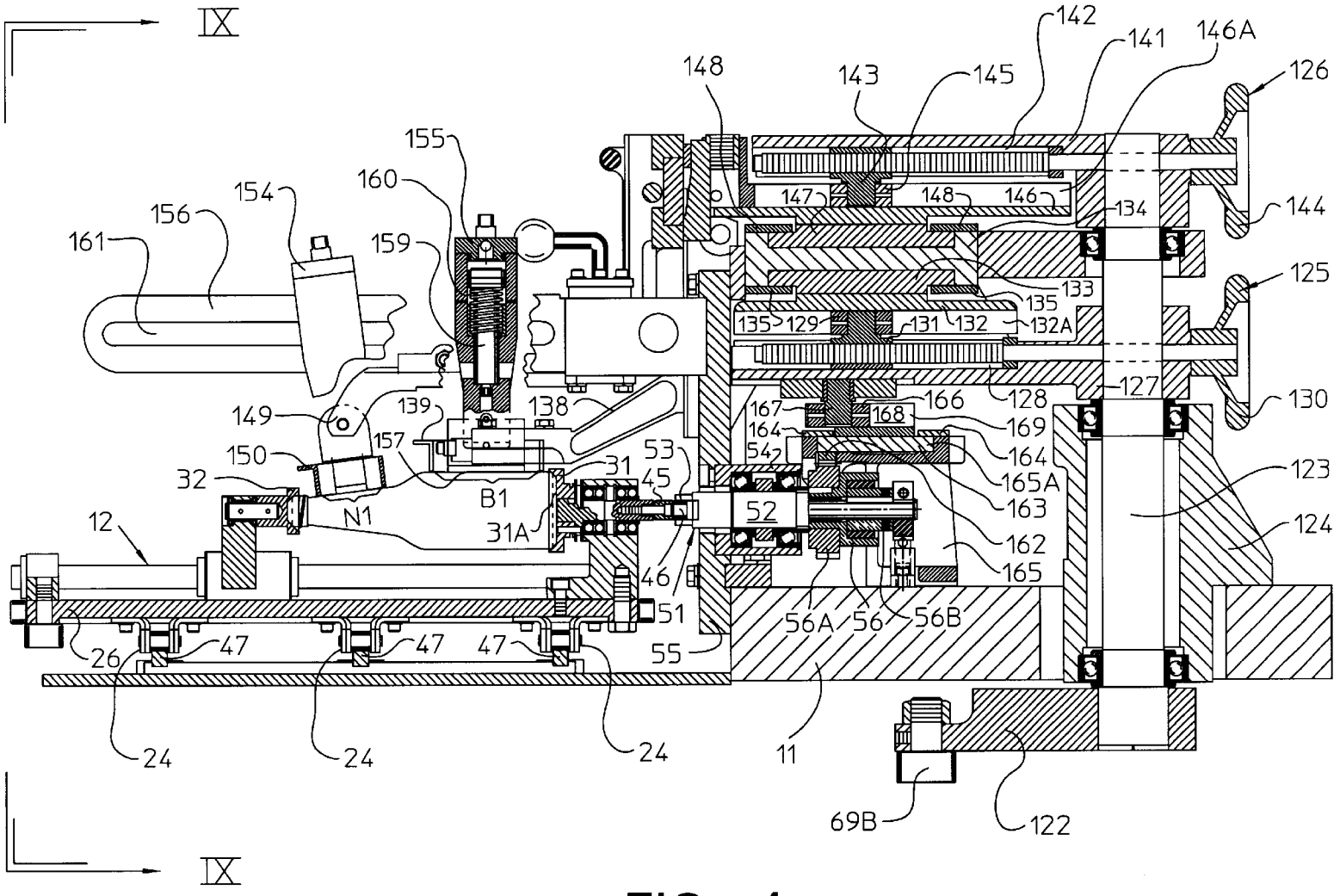
FIG. 4 is an enlarged partial view of the decorating screen and a first embodiment of the bottle rotator shown in FIG. 3.
Figure 5:
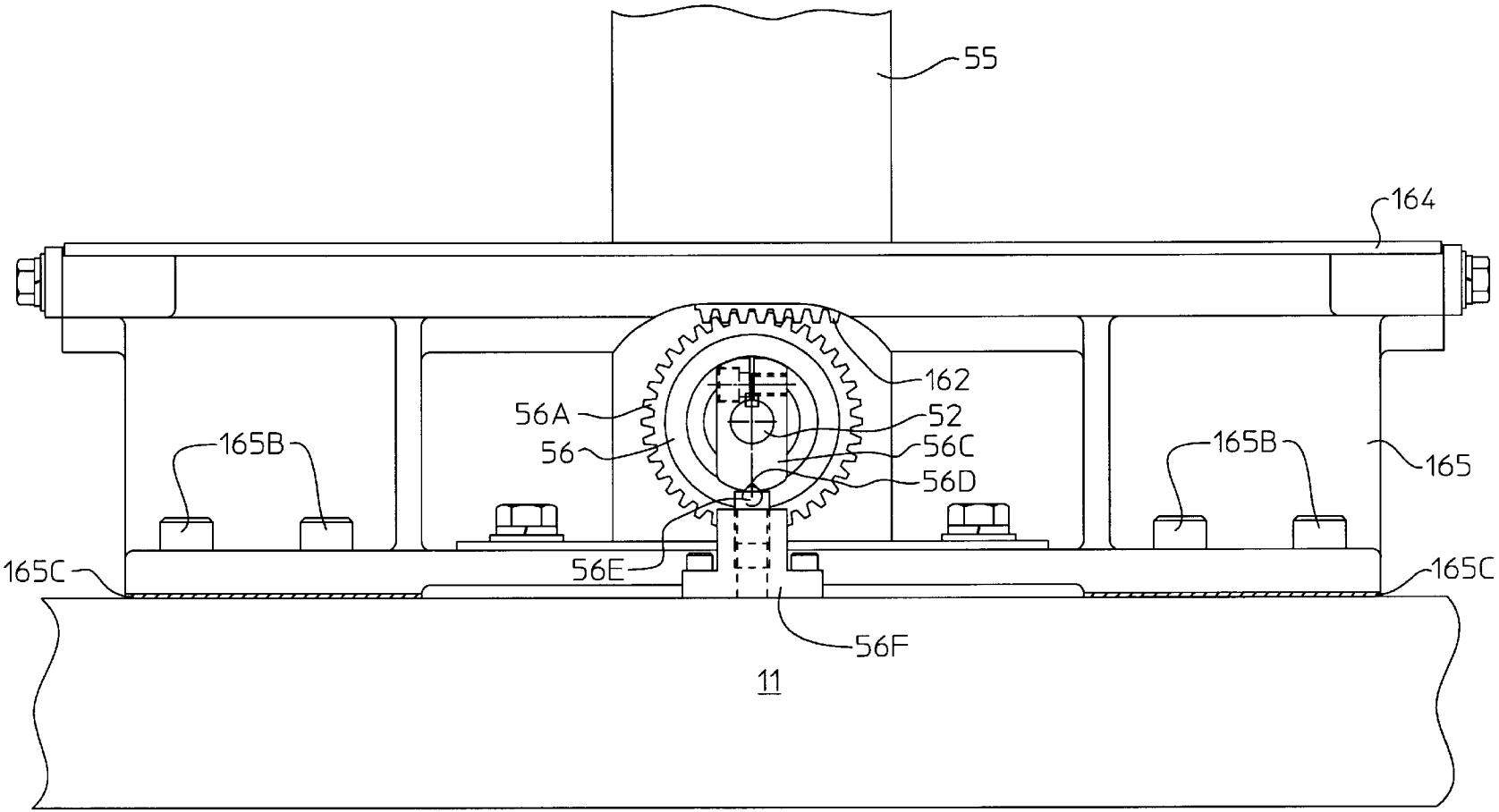
FIG. 5 is a rear elevational view of the bottle rotator drive shown in FIG. 4.
Figure 9:
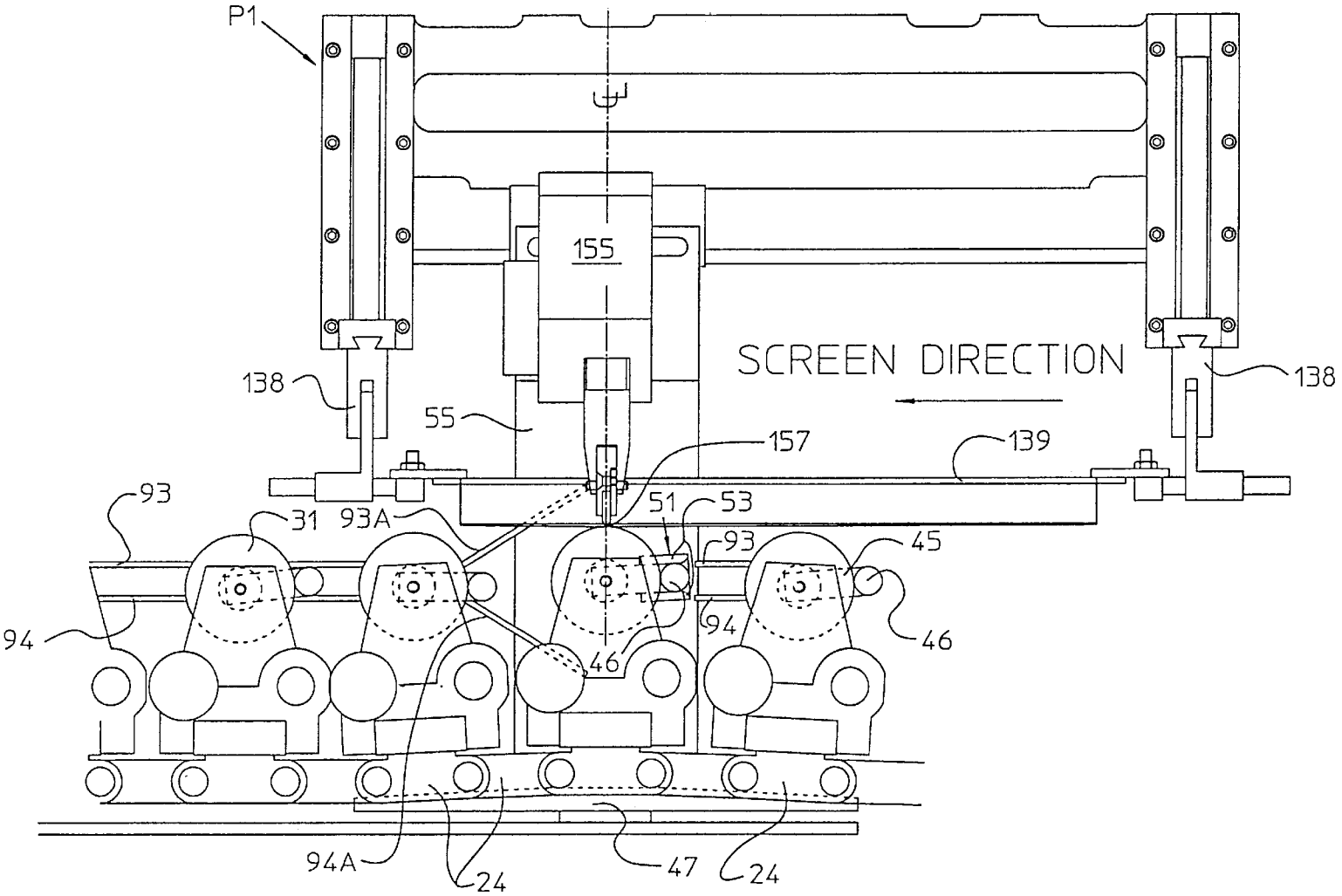
FIG. 9 is an enlarged front elevational view taken along lines IX—IX of FIG. 4.

As shown in FIG. 6 and 8, extending from the base cup 31 is a journal 43 that is rotatably supported by bearings in an upstanding housing 44. An end part of the journal is bolted to a crank arm 45 extending perpendicular to the rotational axis of the journal 43. The free end of crank arm 45 supports a drive roller 46 for rotating the base cup at the registration station 14 and a bottle at each of the decorating station P1, P2 and P3. As will be described in greater detail hereinafter, the crank arm 45 and its drive roller 46 also serve to control the position of the bottle while advanced to and from the decorating stations by the conveyor 12. As best shown in FIGS. 4 and 9, at each decorating station the chain links 24 of each of the conveyor chains 21, 22 and 23 ride along bottle riser cams 47 that elevate the bottle a distance so that the decorating screens can freely move along a linear path of travel in either direction without impingement contact with bottles on adjacent carriers.

At each decorating station P1, P2 and P3 there are arranged a rotator assembly 51 embodying a construction of parts according to a first embodiment of the present invention. As shown in FIGS. 4 and 9, the rotator assembly includes a rotator arbor 52 having an end portion formed with a slot opening 53 into which the drive roller 46 can pass into a driven relationship with crank arm 45 for rotating the bottle mounted on the workpiece carrier for a bottle decorating operation during a screen cycle. Arbor 52 is supported for rotation by spaced apart antifriction bearings mounted in a bearing housing 54 that is in turn supported by a face plate 55 secured to the base 11 of the decorating machine. In the embodiment shown in FIGS. 3–5, a one way clutch 56 is provided with an input drive gear 56A and a drive output sleeve 56B of the clutch is secured to an end portion of arbor 52 extending from the bearing housing 54. The arbor 52 extends outwardly beyond a sleeve 56B and secured to the terminal end portion thereof is a clutch control block 56C having a V-shaped notch 56D for establishing a home start position by the reception of a spring loaded ball 56E held captively in a carrier housing 56F. The arrangement of a one way clutch 56 is provided at each of the decorating stations for rotating the bottle for the decoration cycle. The crank arm 45 trails in the direction of conveyor movement so that the drive roller 46 passes into the slot opening 53 to establish a universal type of drive relation with the rotor arbor 52 as a bottle carrier approaches each of the decorating stations. Important to this drive relation is a coaxial alignment between the rotational axis of the bottle on the carrier and the rotational axis of the arbor 52 of the bottle rotator. The provision of the one way clutch 56 and the arrangement of parts associated with the clutch is used to provide a dwell period for the workpiece rotator drive during which the decorating screen is linearly displaced through a return cycle to a start position. The decorating cycle occurs only once in each machine cycle whereby the machine cycle is altered from well-known machine cycles wherein the screen is used to apply decoration while moved in each of opposite directions. The screen return cycle occurs during a dwell period used for indexing bottles from and into the printing station. The one-way clutch prevents operation of the bottle rotator in this newly structured dwell period to prevent wreckage of the machinery that would otherwise occur should the bottle rotator execute return rotation while bottles are advanced to and from the decorating station.

Figure 3:
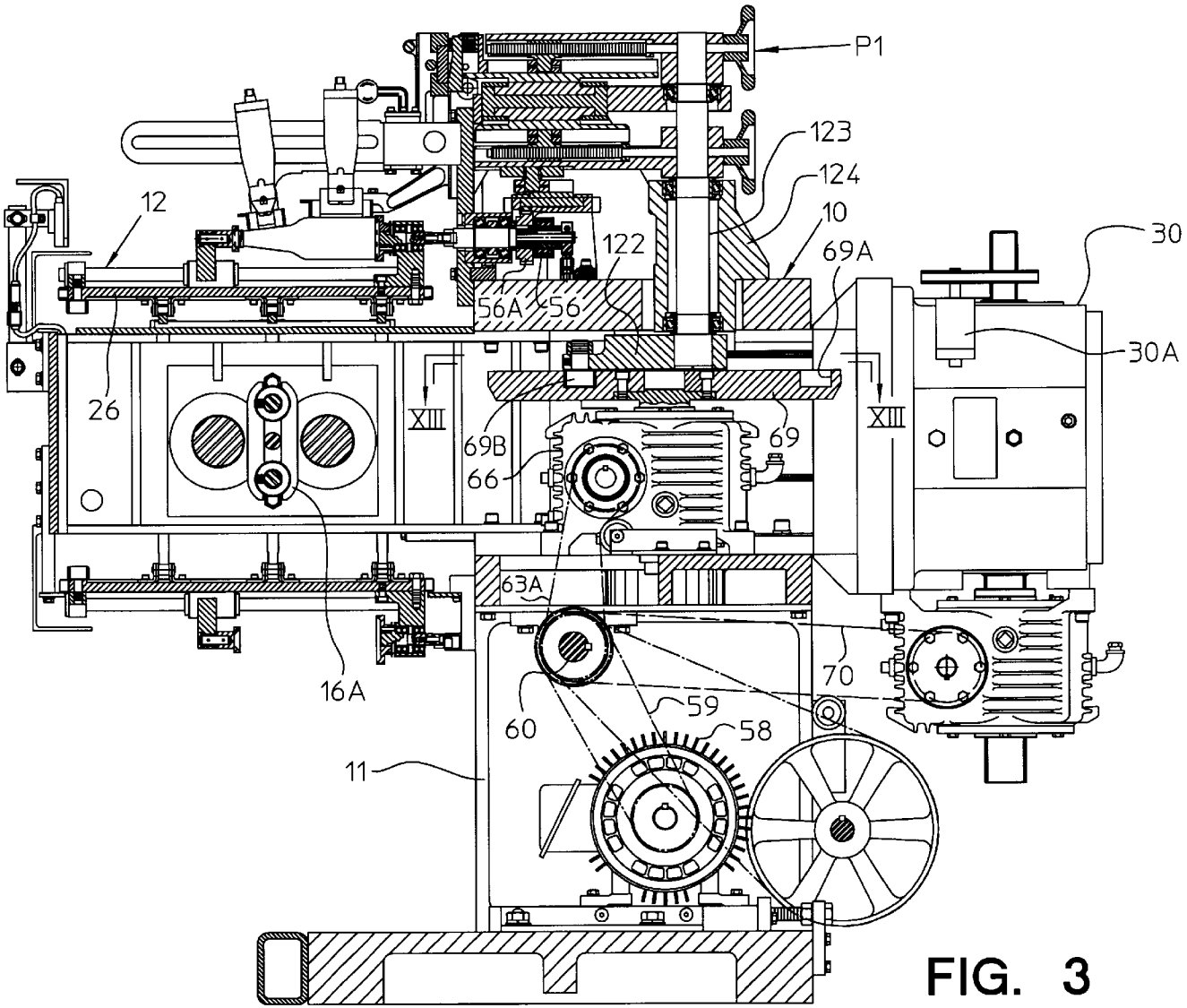
FIG. 3 is a sectional view taken along lines III—III of FIG. 1.
Figure 7:
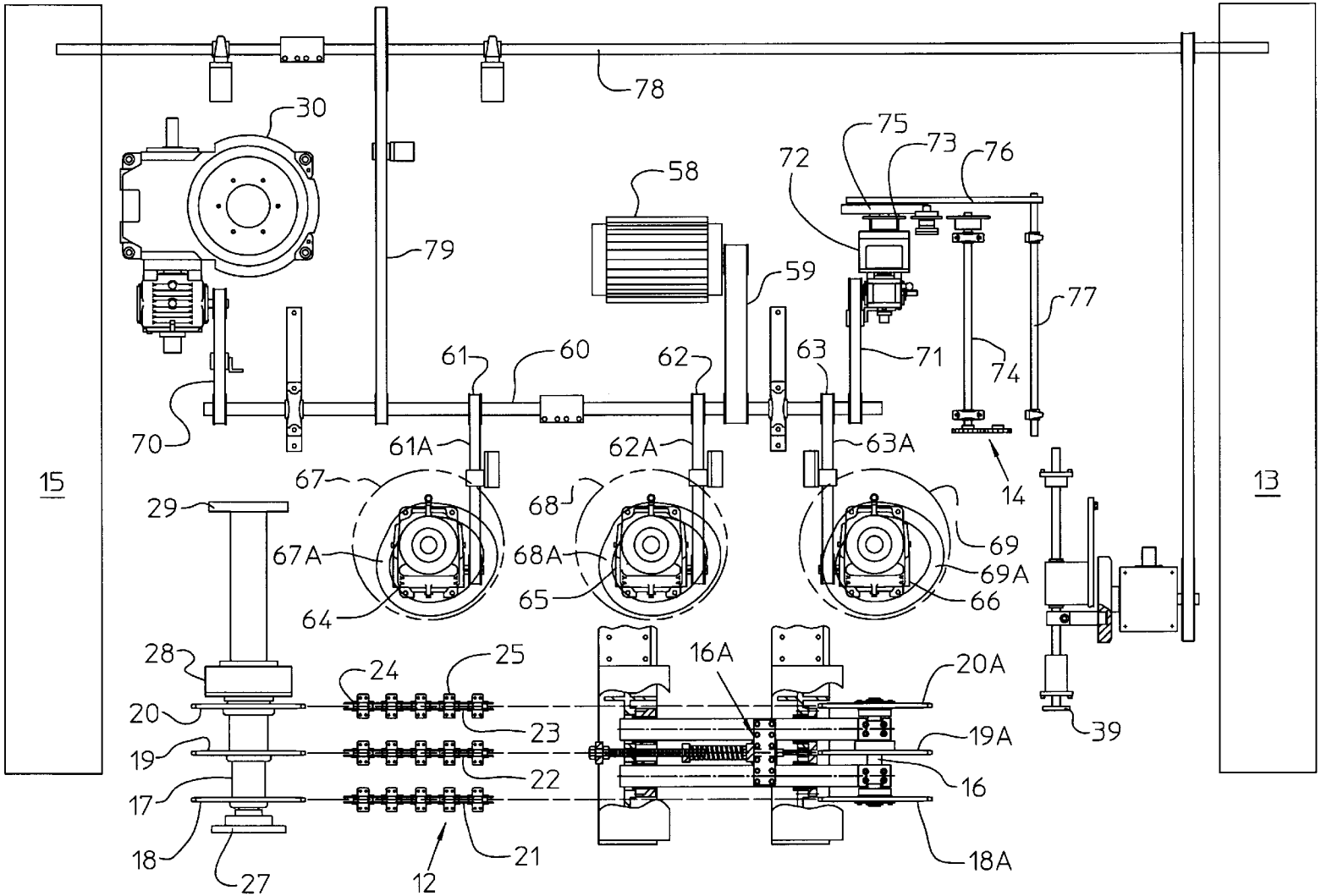
FIG. 7 is a schematic drive layout illustrating the major drive components for the decorating machine shown in FIG. 1.
Figure 11:
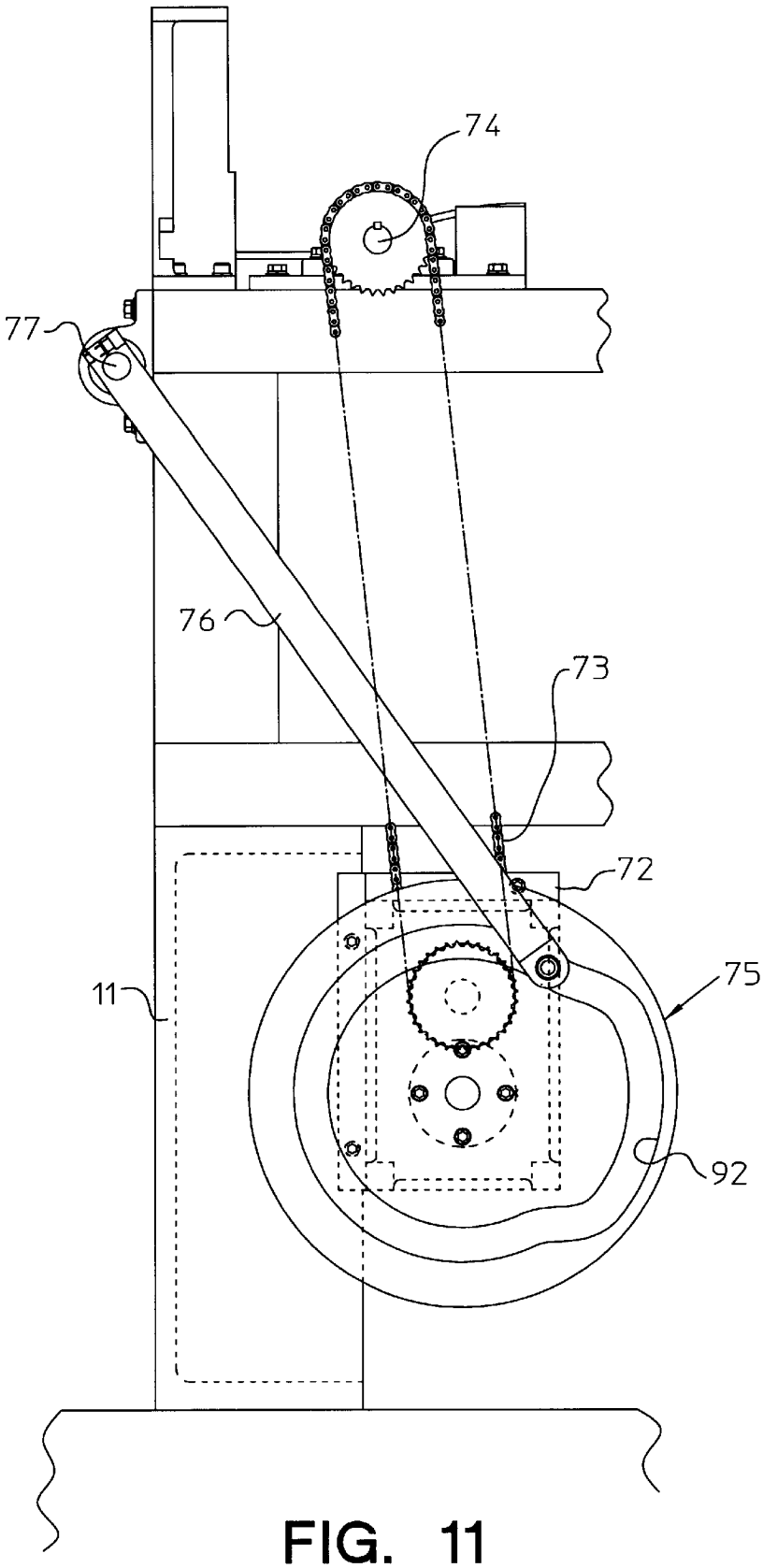
FIG. 11 is an elevation view taken along lines XI—XI of FIG. 1.

The drive arrangement for the decorating machine includes, as shown in FIGS. 3 and 7, a main drive motor 58 having a drive output shaft connected by a belt 59 to a first line shaft 60. Spaced along line shaft 60 are three pulleys 61, 62 and 63 provided with belts 61A, 62A and 63A extending to gear drives 64, 65 and 66, respectively. The gear drives have output shafts secured to rotate cams 67, 68 and 69 having identical closed cam tracks 67A, 68A and 69A, respectively. A closed cam is also known as a face groove or positive cam. Each cam has a follower in the respective cam track to pivot an oscillating drive input to the respective decorating station. The first line shaft 60 is also provided with a pulley connected by a belt 70 to a drive shaft of the conveyor index box 30. A further belt 71 connects a pulley mounted on line shaft 60 to an index drive 72. As shown in FIGS. 7 and 11, the index drive 72 has an output shaft on which is mounted one of meshing drive gears to drive a sprocket carried by idler shaft for a chain 73 to rotate a registration drive shaft 74. Also mounted on the output shaft of index drive 72 is a cam 75 connected by a drive arm 76 to oscillate a shaft 77 for a registration head. Returning to FIG. 7, the first line shaft 60 is drivenly coupled to a second line shaft 78 by belt 79 trained between pulleys mounted on the line shafts. Line shaft 78 has spaced apart pulleys connected by belts to drive the bottle loading equipment 13 and bottle unloading equipment 15, in a manner per se, well known in the air.

Figure 2:
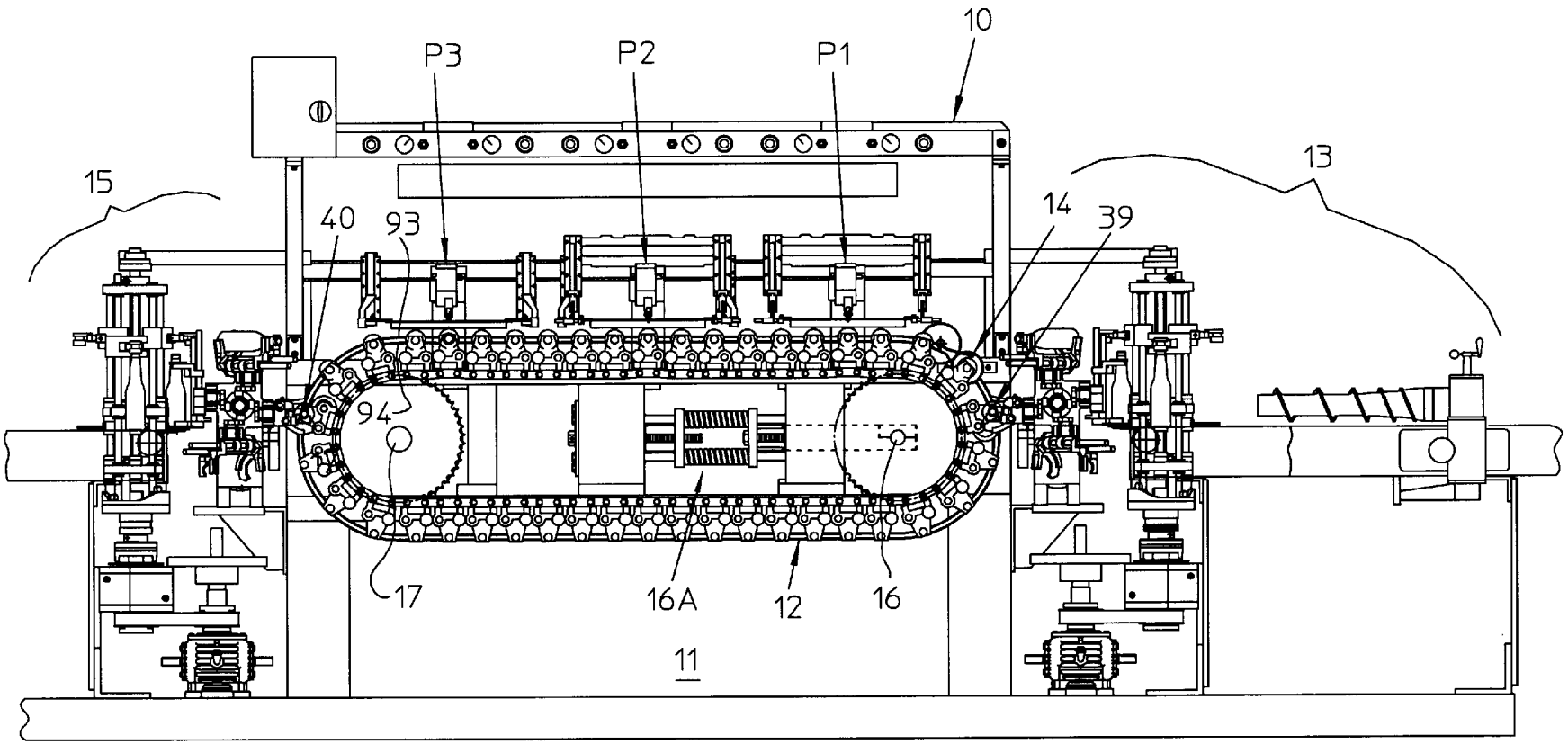
FIG. 2 is a front elevational view of the decorating machine shown in FIG. 1.
Figure 10:
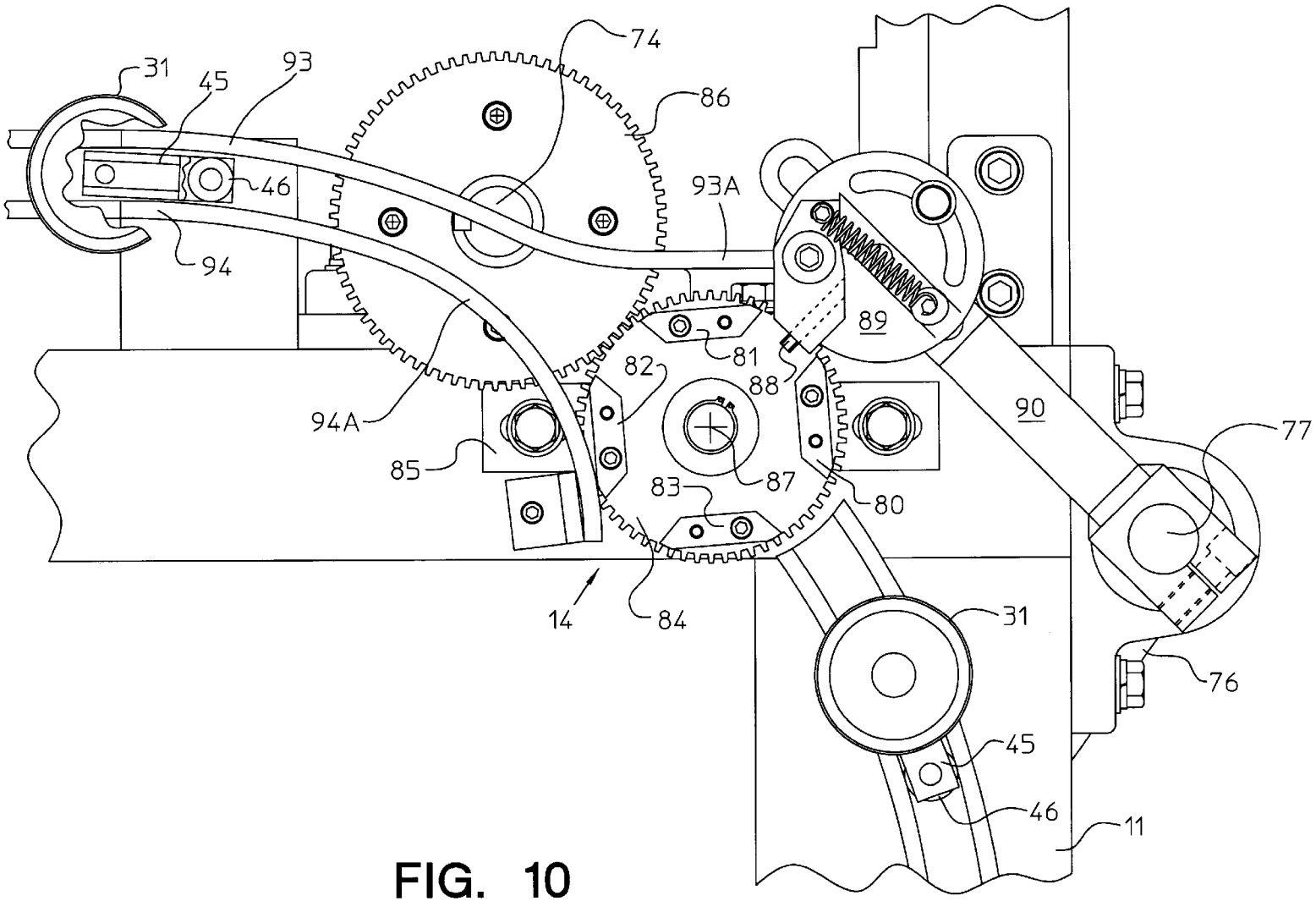
FIG. 10 is an enlarged elevation view of the registration station located at the entry side of the workpiece conveyor for the decorating apparatus of the present invention.

As shown in FIGS. 2, 10 and 11, as the bottles are supplied by the bottle loading equipment 13 to the decorating machine, the bottles are received by the workpiece carrier while arranged horizontally and supported between base cup 31 and neck chuck 34 of the carriers and thence advanced intermittently to the registration station 14. As the bottles arrive at the registration station, the drive roller 46 on the end of the crank arm 45 passes into one of four peripherally spaced openings between drive blocks 80, 81, 82 and 83 on a face of a gear 84. Gear 84 is rotatably supported by bearings in a bearing housing 85 secured to a frame forming part of the base 11. The gear teeth of gear 84 mesh with gear teeth of a gear 86 mounted on an end portion of registration drive shaft 74 which, as previously described, is driven by a chain drive arrangement shown in FIG. 10 connected to an index drive 72. The bottle is rotated about its longitudinal axis by the bottle rotating drive gear 84 that rotates about a drive axis 87. A registration finger 88 is pivotally mounted on a finger mounting plate 89 at a predetermined location along a slotted end portion of a registration arm 90 so that the registration finger 88 extends into the path of travel of a registration cavity formed in the lower base portion of the bottle. The registration arm 90 is secured to the drive shaft 77 supported by bearings and driven by the pivot arm 76 as shown in FIG. 10 in response to oscillations produced by a follower in a closed cam track 92 also known as a face groove or positive cam driven by a drive output shaft of index drive 72. The motion imparted to the registration arm 90 moves the registration finger into its operative position so that when the registration finger passes into the registration cavity of the bottle, rotation of the bottle is stopped thereby, and slippage occurs between the bottle base and the base cup 31 as the cup continues to rotate to completion of the bottle registration cycle.

When bottle rotation is stopped there is established a predetermined bottle orientation with respect to the decorating screens because the decoration screens are also stationary at a start position at this time so that thereafter bottle rotation and screen movement are always in a synchronous speed relation. The registration process is particularly useful to orientate seam lines extending along opposite sides of a bottle with respect to the location of the desired area on the surface of the bottle intended to receive decoration. Registration of the bottle is concluded with the orientation of the crank arm 45 such that the drive roller 46 trails the advancing movement of the bottle carrier in an intermittent fashion to the decorating stations. As the drive roller 46 emerges from a slot between the drive blocks 80–83, the roller 46 is captured and guided by spaced apart guide rails 93 and 94. These guide rails extend along the course of travel by the drive roller 46 throughout the indexing movement by the conveyor to thereby maintain registration of the bottle at each decorating station. As shown in FIGS. 2 and 9, the guide rails 93 and 94 form an endless path to capture the roller 46 and thereby guide the crank arms 45 of each of the bottle carriers. However, at each of the decorating stations P1, P2 and P3 the continuity of the guide rails 93 and 94 are interrupted by a gap wherein a rotator assembly 51 is located to receive and rotate the bottle. Downstream of each decorating station are outwardly protruding collector rail portions 93A and 94A that return the roller and crank arm to the gap between guide rails 93 and 94 as the conveyor operates to advance bottles after completion of the decorating cycles.

At each decorating station P1, P2 and P3 the arrangement of decorating apparatus is identical. As shown in FIGS. 3, 4 and 7, it can be seen that for decorating station P1, the gear drive 66 has its output drive shaft connected to rotate the cam 69. A cam follower 69B is received in the cam track 69A of the cam 69. The cam follower is mounted to a lever arm 122 which is in turn secured to the lower end of a vertical shaft 123. The shaft 123 is supported by spaced apart bearings which are in turn carried by a tubular column 124 supported by the base of the decorator machine 11. At the top of the column 124 there are superimposed oscillation arm assemblies 125 and 126. Assembly 125 is made up of a lever arm 127 secured to shaft 123 and provided with a "U"

shaped guideway 128 extending radially of the shaft. In the guideway there is arranged a drive bar 131 which can be moved along the guideway by the threaded portion of a hand wheel 130. The distance the drive bar 131 is located radially of the rotational axis of shaft 123 is controlled by the hand wheel 130. A drive block 129 is mounted on a portion of the drive bar 131 projecting vertically above the guideway and reciprocates in an inverted "U" shaped guideway 132A formed in a drive bar 132. The drive bar is joined to a slide 133 supported in a guideway 134. The slide is held in a slot of guideway 134 by gib plates 135. While not shown, the slide 133 protrudes laterally from opposite sides of the tubular column 124 and is provided with outwardly spaced apart receiver arms 138. The receiver arms 138 engage a decorating screen assembly 139 reciprocated by the linear motion of the slide 133 to thereby reciprocate the decorating screen assembly along the body portion B1 of a bottle for carrying out decorating operations thereon.

Assembly 126 includes a lever arm 141 secured to shaft 123 and provided with a "U" shaped guideway 142 extending radially of the shaft. In the guideway there is arranged a drive bar 143 which can be moved along the guideway by the threaded portion of a feed screw operated by a hand wheel 144. The distance the drive bar 143 is located radially of the rotational axis of shaft 123 is controlled by the hand wheel 144. A drive block 145 is mounted on a portion of the drive bar 143 projecting vertically downwardly from the guideway 142 and reciprocates in a "U" shaped guideway 146A formed in a drive bar 146. The drive bar is joined to a slide 147 supported in the guideway 134. The slide 147 is held in a slot of guideway 134 by gib plates 148. The slide 147 protrudes laterally from opposite sides of the tubular column 124, in the same manner as slide 133 protrudes and is provided with outwardly spaced apart receiver arms 149 that in turn engage with a decorating screen assembly 150 which is reciprocated by the linear motion of the slide 147 to thereby reciprocate the decorating screen assembly along the neck portion N1 of a bottle for carrying out decorating operations thereon.

Hand wheels 130 and 144 are used to select a desired stroke for the screen reciprocation to match the circumferential distance of the bottle which is to be decorated. This matching relationship is critically significant because no relative motion between the screen movement and the bottle rotation can be accepted otherwise, smearing or poor quality decorating will occur. As shown in FIG. 4, squeegees 154 and 155 are carried by a support arm 156 in positions above the decorating screen assemblies 139 and 150, respectively. The squeegee construction is per se is known in the art and is shown in U.S. Pat. No. 3,172,357. Each squeegee includes a squeegee rubber 157 on the end portion of squeegee positioning cylinder 159 operated pneumatically against the force of a return spring 160 thereby to establish line contact between the screen assemblies 139 and 150 and a bottle as the bottle is rotated in a synchronous speed with linear movement of the screens. The squeegee positioning cylinder 159 are connected to a source of pneumatic pressure through an electrically operated control valve responsive to a control signal supplied by a programmable limit switch responsive to an input signal from a resolver 30A (FIG. 3). The resolver is mounted to the housing of the conveyor index box 30 and drivenly coupled to respond to rotatory input motion of the index box. The programmable limit switch, per se well known in the art, is programable to provide a plurality of discrete electrical output control signals each designed to provide electrical control of diverse machine elements at preselected intervals during each machine cycle of a decorator. The squeegees are adjustably located by fasteners engaged in a mounting slot 161 extending along the elongated length of the support arm 156.

At each decorating station there is provided as part of the screen drives, a drive to rotate the rotator assembly 51. As described previously and shown in FIGS. 4 and 5, the rotator assembly includes a drive input gear 56A of a one way clutch 56 which is located beneath lower arm 127 where the teeth of gear 56A mesh with teeth of an elongated gear rack 162. Gear rack 162 is secured to a slide 163 which is constrained by gib plates 164 to reciprocate in an U-shaped channel 165A formed in a pedestal 165 mounted on base 11 by bolts 165B. Shims 165C are inserted between opposite ends of the pedestal 165 and the base 11 to adjust the elevation of the gear rack 162 for eliminating backlash between the meshing teeth of the gear rack 162 and the drive gear 56A. In the course of use of the decorating machine, adjustments to the shim height are needed to compensate for wear of rack 162 and gear 56A and wear of the roller members secured to links 24 forming part of the chain conveyor. A drive block 166 is driven by a drive pin 167 mounted in a socket formed in a mounting plate secured to the underside of the lever arm 127. The drive block 166 is seated in an U-shaped channel 168 formed in a guide way 169 secured to the slide 163. Drive pin 167 serves to convert oscillating motion of lever arm 127 to linear motion of the slide 163 by the intermediate sliding motion of the drive block 166 within the U-shaped channel 168 in guide way 169. The slide 163 is mechanically secured to the gear rack 162 for rotating drive gear 56A and thereby the bottle rotator for rotating a bottle for a decorating operation.

Figure 12:
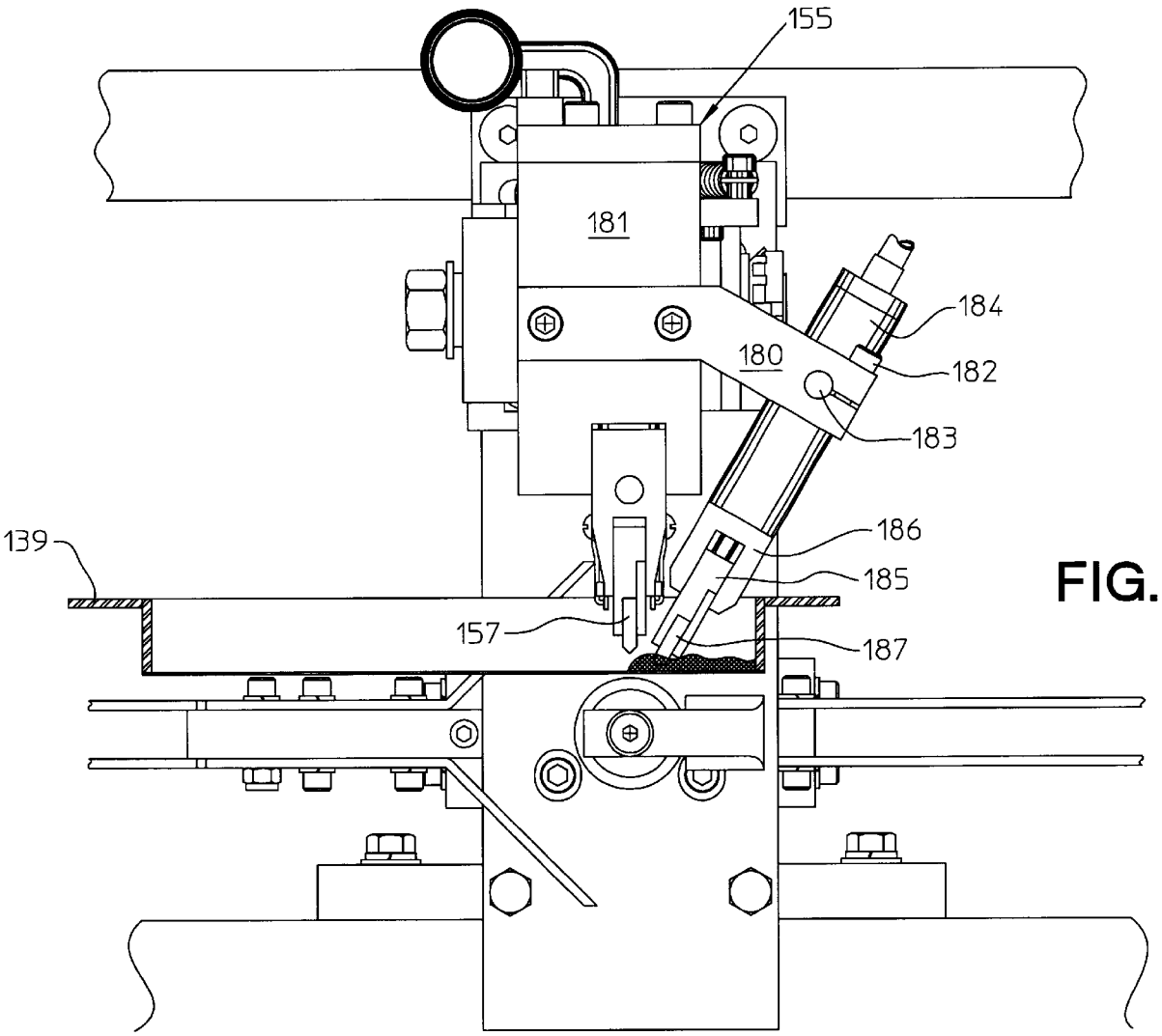
FIG. 12 is an enlarged fragmentary view illustrating a flood blade for controlling the distribution of printing medium in a decorating screen.
Figure 13:
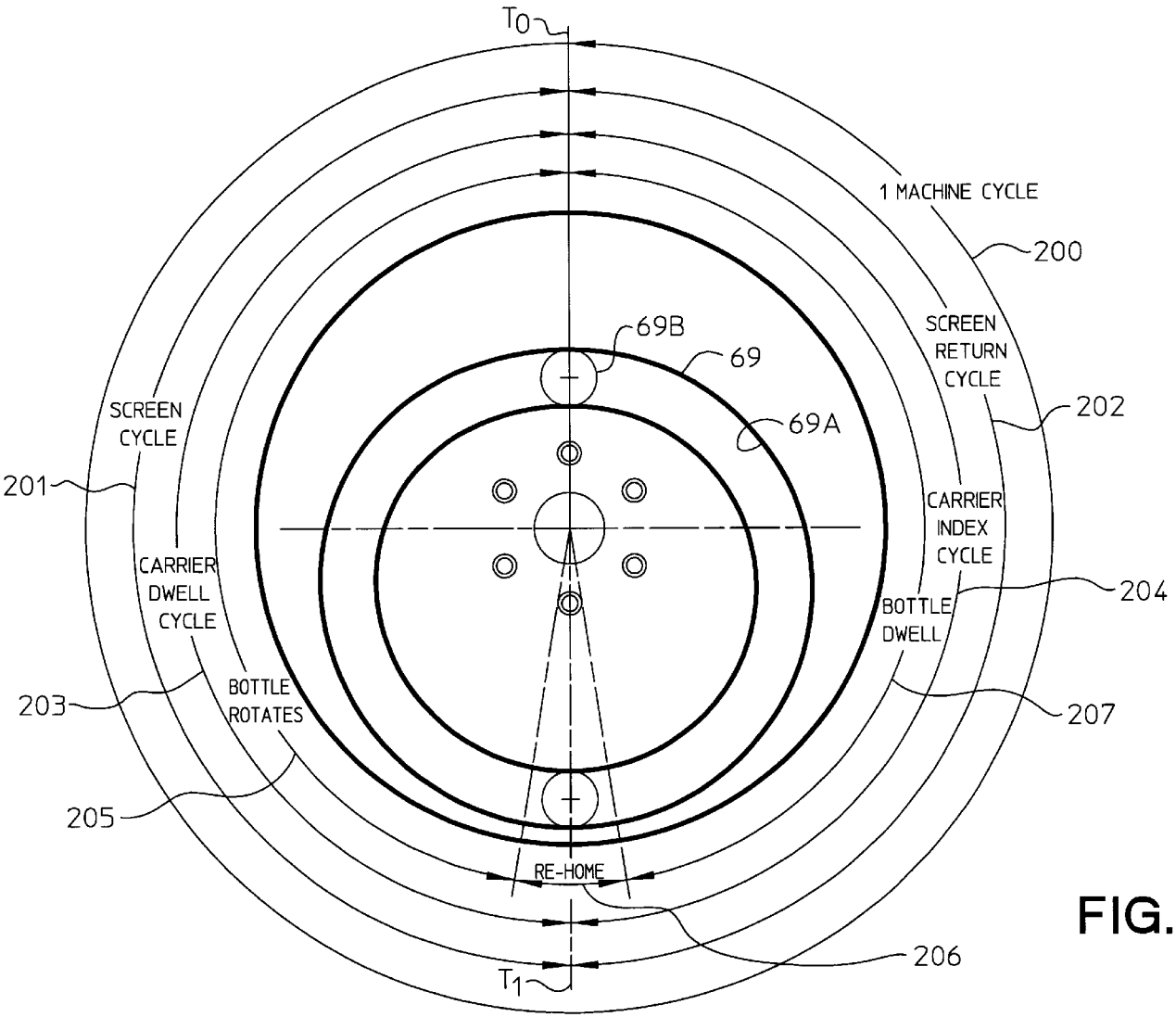
FIG. 13 is a sectional view taken along lines XIII—XIII of FIG. 3 showing the cam track configuration for providing one decorating cycle in each machine cycle for high quality decoration.
Figure 14:
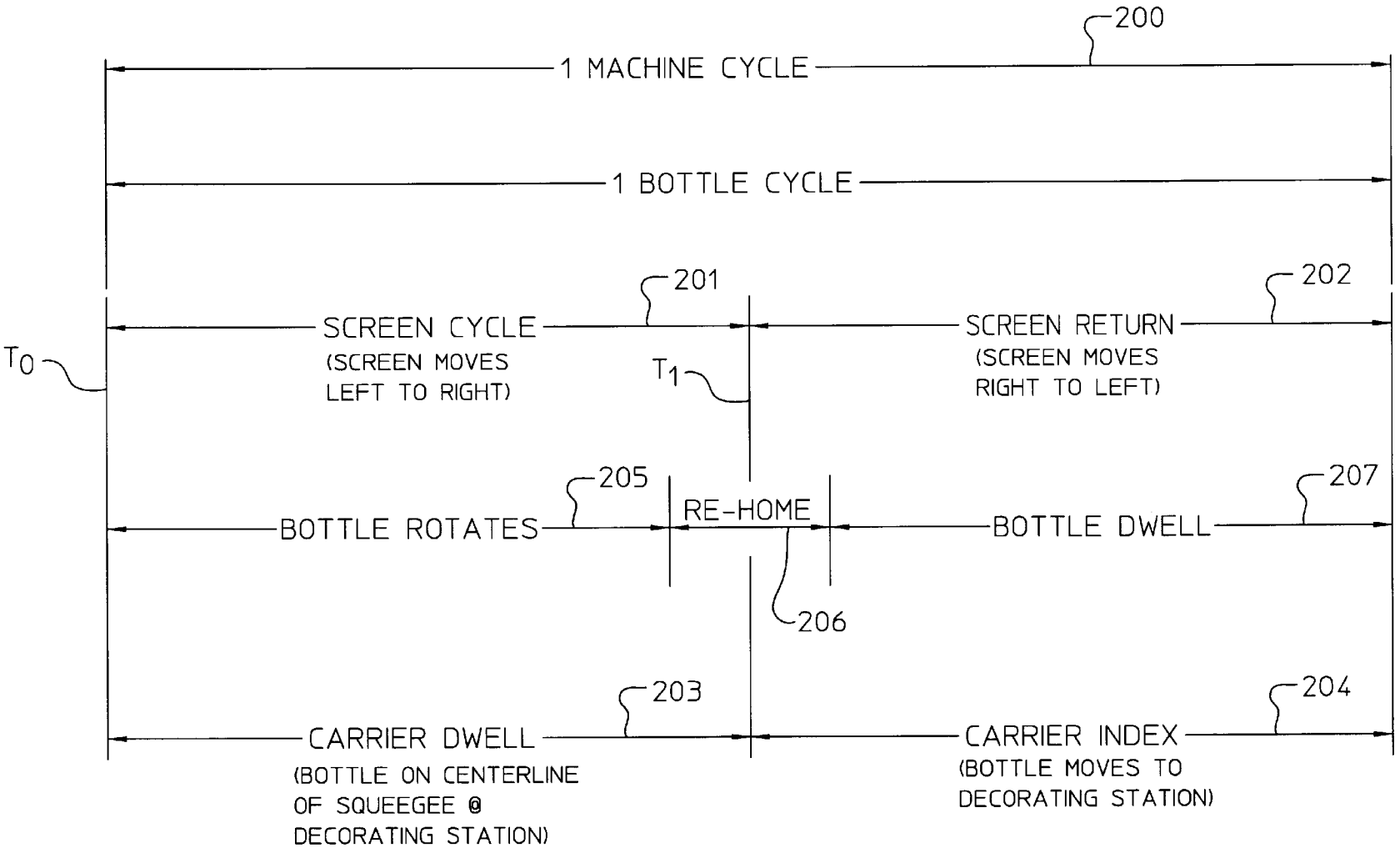
FIG. 14 is a timing sequence diagram showing consequent cycles of the machine cycle according to the cam track configuration of FIG. 13.

In the past when the decorating screen was displaced in one direction to decorate a workpiece and then displaced in a reverse direction again to decorate a workpiece, the distribution of printing medium on the decorating screen remained uniform since a volume of printing medium was carried against the surface of the squeegee as the screen was reciprocated in each direction. However, when the decorating screen is displaced through a screen return cycle so that printing occurs with displacement of the screen always in the same direction it is preferred to provide a carrier blade to return the excess volume of printing medium carried by the squeegee to the end of the decorating screen at the conclusion of the decorating stroke of the screen to a start location of the decorating screen to maintain an adequate supply of printing medium for each one-way decorating stroke by the screen. For this purpose as shown in FIG. 12, there is provided a support frame 180 secured to the housing 181 of squeegee actuator 155. Frame 180 has a clevis mounting at the extended free end thereof controlled by a threaded fastener 182 to apply a clamping force to a trunnion 183. The trunnion extends from a housing of a piston and assembly 184 having the rod end thereof secured to a mounting bar 185. The mounting bar is guided by an U-shaped extension 186 to the housing at the rod end of the piston and cylinder assembly. A flood blade 187 is mounted on the mounting bar 185 and moved from the inoperative position to an operative position shown in FIG. 12 in which the extended edge surface of the blade 187 is closely spaced from the surface of the decorating screen. The blade 187 is moved into the operative position during that part of the machine cycle when the decorating screen is returned to a start position at the conclusion of a screen cycle to transport a volume of printing medium to the end of the decorating screen where squeegee 157 establishes line contact between a decorating screen and a bottle for a succeeding decorating cycle.

The present invention provides that decoration applied to a bottle at each of the decorating stations by providing that a synchronous speed relation is established between the linear displacement of the decorating screen and the surface of the bottle to receive decoration. This synchronous speed relation must occur after the transmission of torque forms metal-to-metal driving relationships between the numerous sliding and rotating surfaces in the drive system used to move a decorating screen assembly from a start position and by a concurrent rotation of a workpiece by a bottle rotator. The same synchronous relationship must be established at each decorating station and for all the successive decorating cycles at all of the decorating stations. The present invention seeks to eliminate or at least minimize adverse effects to the decoration quality caused by excursions through operating clearances each time a torque transmitting relationship is reestablished between the various sliding and rotation surfaces of the drive system used to rotate the bottle rotator.

According to the present invention, the application of high quality decoration to bottles at each decorating station is carried out in an identical fashion by the provision of identical machine cycles defined by the profile of the closed cam tracks in the cams 67, 68, and 69 (FIG. 7) and the provision of the one-way clutches 56 in the drive train of the bottle rotators. Reference is now made to FIGS. 4, 5, 13 and 14 and for the purpose of describing a machine cycle, the decorating station P1 having the cam identified by reference numeral 69 hereinbefore will form part of the description of the machine cycle. Reference numeral 200 identifies a machine cycle consisting of 360 degrees of rotation of cam 69. A screen cycle 201 begins with travel of the decorating screen along a linear path in response to movement of the follower in cam track 69B from a site designated $T_0$. The screen cycle occurs during rotation of the cam ending at a site $T_1$, e.g., 180 degrees of cam rotation, immediately followed by a screen return cycle 202 consisting of rotation of the cam through the remainder of the machine cycle ending at site $T_0$. Occurring concurrently with the duration of the screen cycle 201 is a carrier dwell cycle 203 during which the bottle dwells at the decorating station. A carrier index cycle 204 occurs concurrently with the duration of the screen return cycle 202. A bottle rotating cycle 205 wherein the bottle is rotated 360 degrees by the rotator 51 starts concurrently screen cycle 201 and carrier dwell cycle 203, but ends before the termination of the screen cycle and carrier dwell cycle by the commencement of a re-homing cycle 206 which spans the transition of the screen cycle to screen return cycle and the transition of carrier dwell cycle to carrier index cycle.

The re-homing cycle has a relatively short duration sufficient to provide a short period of machine cycle time, if such is necessary, during which the detent ball 56E seats in a V-shaped groove in the clutch control block 56C. A rotator dwell period 207 occupies the period between termination of the re-homing cycle and site $T_0$. It is important to note that the torque for rotating the bottle during the carrier dwell cycle 202 is supplied through the same drive train used to linearly displace the decorating screen assembly 139 which includes, for example, cam 69, cam follower 69B, lever arms 127 and 141, slides 133, 147 and 163, drive blocks 129, 145, 167, and gear rack 162 and drive gear 56A. All of these drive elements are design and constructed to provide necessary operating clearances which are reduced to metal to metal, torque transmitting relationships throughout each of the screen cycle 201 and the screen return cycle 202. However, when the screen cycle 201 ends and the screen return cycle 202 starts, the operating clearances are all completely traversed between the drive elements, i.e., cam 69, cam follower 69B, lever arms 127 and 141, slides 133, 147 and 163, drive blocks 129, 145, 167, and gear rack 162 and drive gear 56A. The excursion through operating clearances occurs a second time in the machine cycle at the commencement of a second machine cycle when the screen return cycle 202 ends and the bottle rotation cycle 205 and screen cycle 201 begin at site $T_0$ thus restoring the relationship that existed at the commencement of the previous machine cycle providing both consistent decoration placement at a desired site on the workpiece and synchronous speed relation between movement of the screen in the screen cycle and peripheral rotational speed of the decoration receiving surface of the bottle. This eliminates adverse effects to the registration of decorations such as color-to-color on the decoration surface of the bottle that hereto for occurred without the provision of a screen return cycle.

Figure 15:
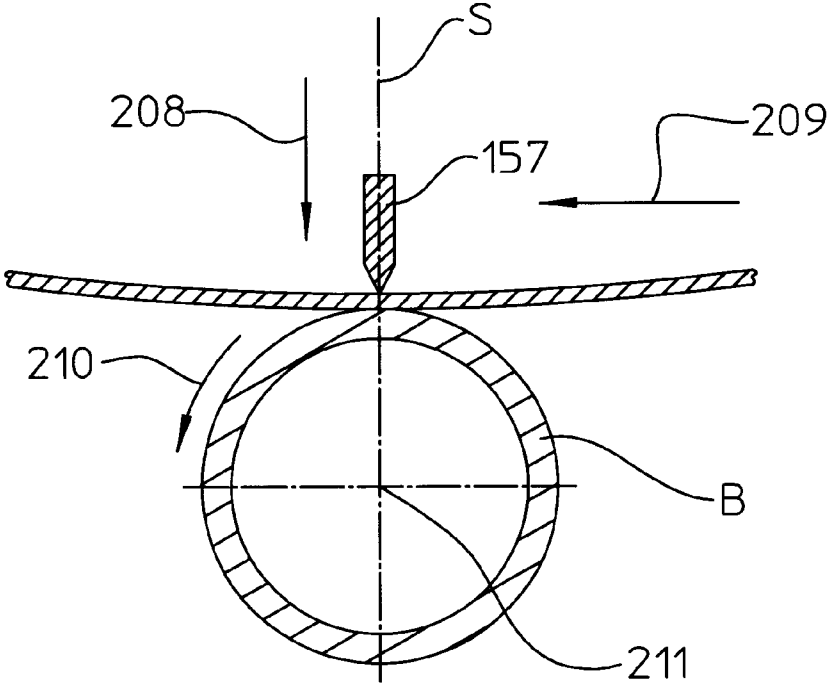
FIG. 15 is a view illustrating a relationship of the decorating screen, squeegee and a bottle during a printing operation according to the present invention.

FIG. 15 illustrates the relationship of the bottle in the decorating apparatus at time $T_0$. It will be observed that a decorating plane is defined by a vertical plane S passing through a squeegee rubber 157. The squeegee rubber is moved by the squeegee actuator 155 along the vertical plane S as indicated by arrow 208 to a downward operating site. Linear movement of the decorating screen is initiated in the direction indicated by arrow 209. At the same time, the bottle B commences rotation about a longitudinal axis of the bottle in the direction indicated by arrow 210 by a rotator assembly 51. The rotational axis of the bottle and the rotational axis of the rotator are coaxial and indicated by reference numeral 211. It is important that a coaxial relationship always exists during the decoration of a bottle to avoid a variation to the rotational speed of the bottle that would otherwise occur because of an eccentric, non coaxial relationship between the rotational axes of the bottle and the rotator.

Figure 16:
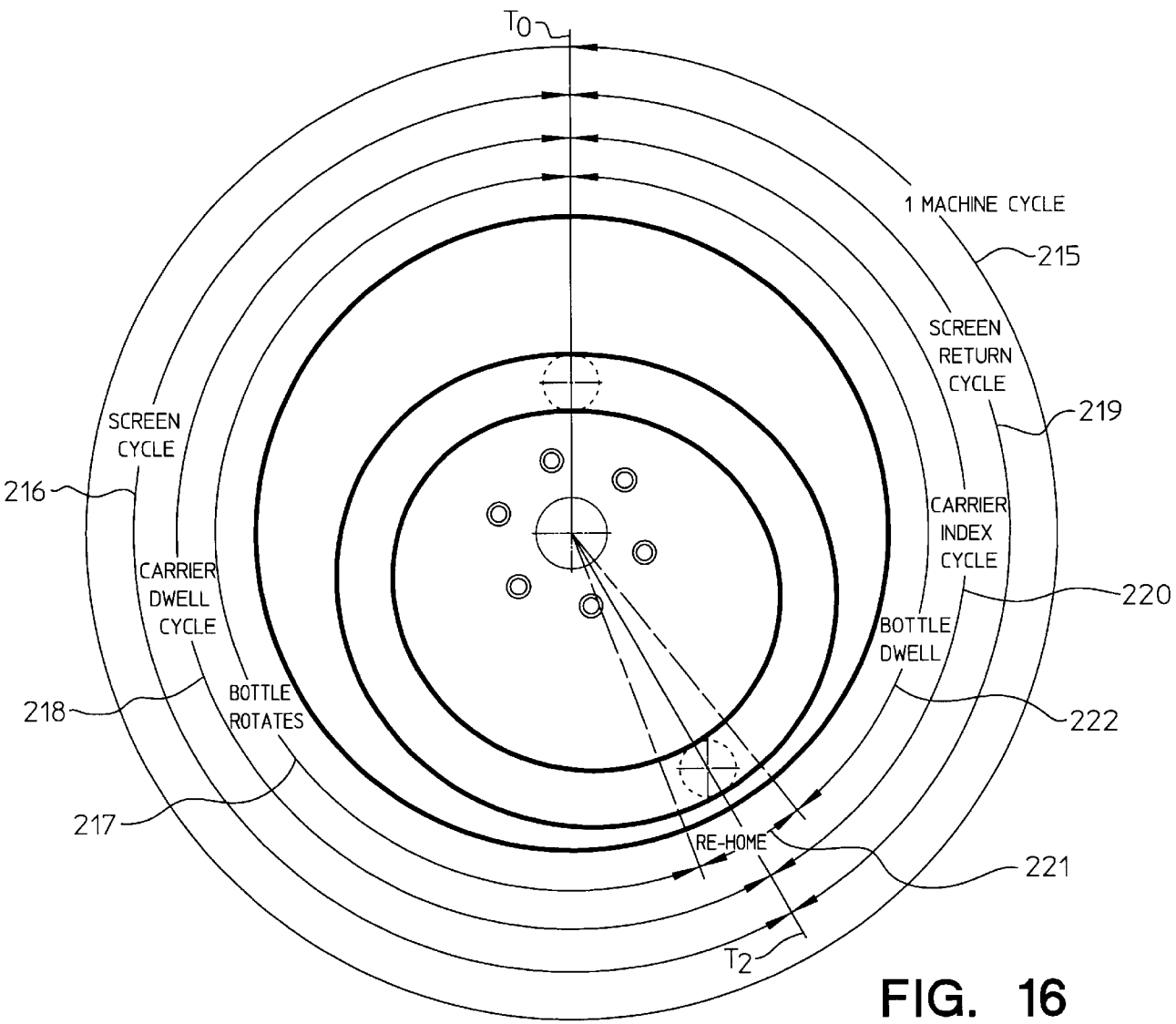
FIG. 16 is a view similar to FIG. 13 and illustrating a further embodiment of cam track configuration for providing one decorating cycle in each machine cycle.
Figure 17:
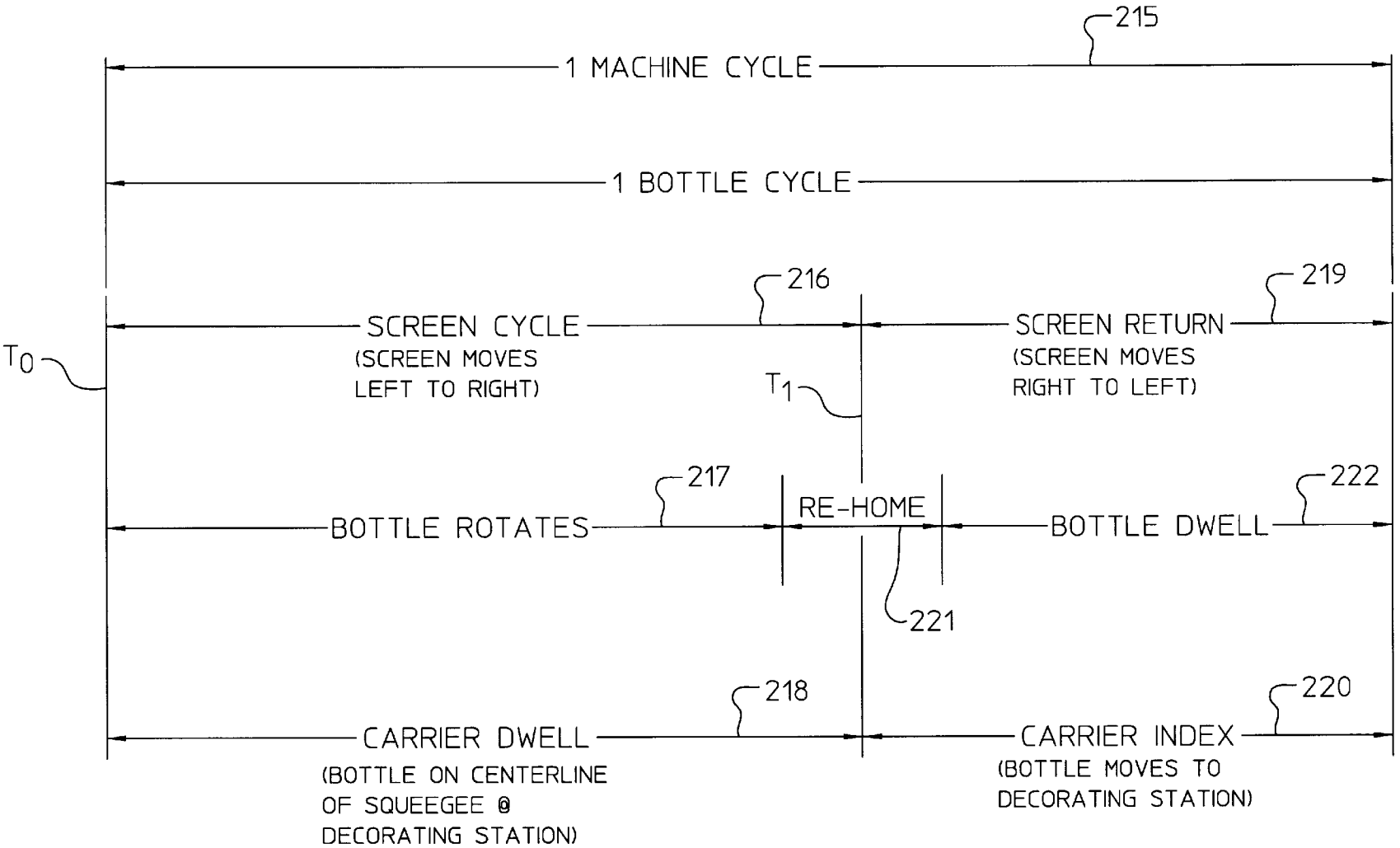
FIG. 17 is a view similar to FIG. 14 and illustrating a timing sequence diagram for the component cycles of the machine cycle according to the cam track configuration of FIG. 16.
Figure 18:
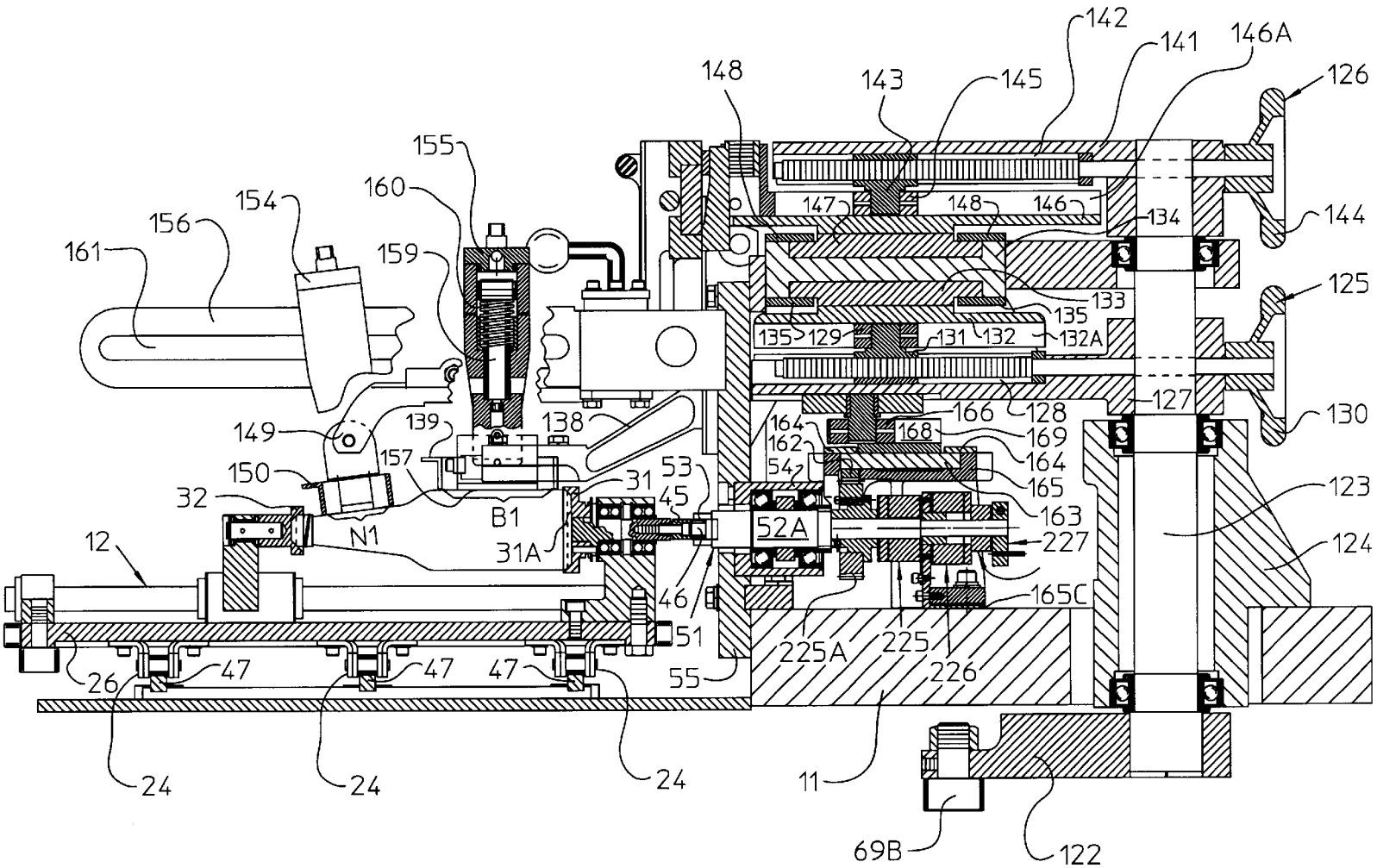
FIG. 18 is a sectional view similar to FIG. 4 and illustrating a second embodiment bottle rotator according to the present invention.
Figure 19:
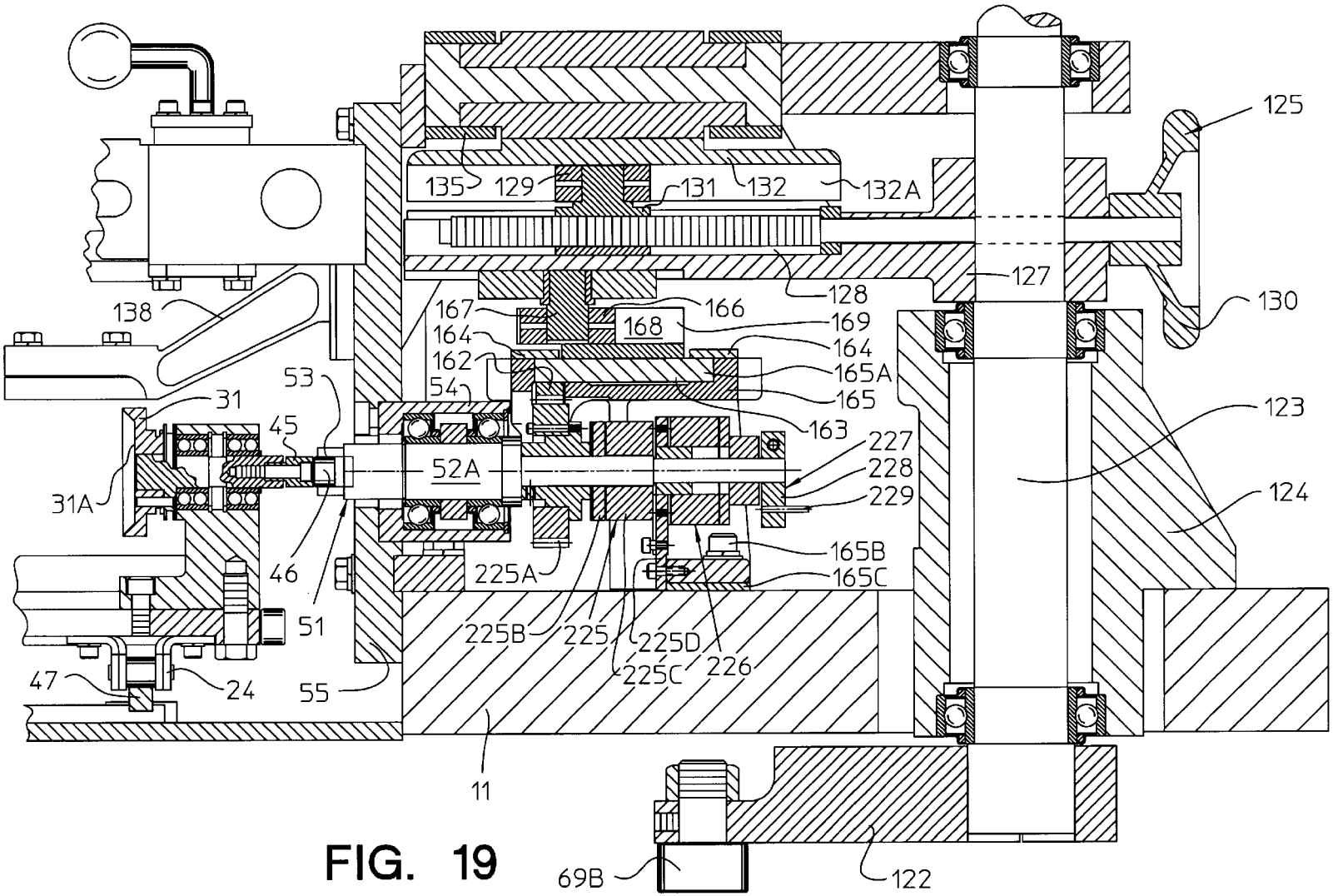
FIG. 19 is an enlarged view of the bottle rotator drive shown in FIG. 18.
Figure 20:
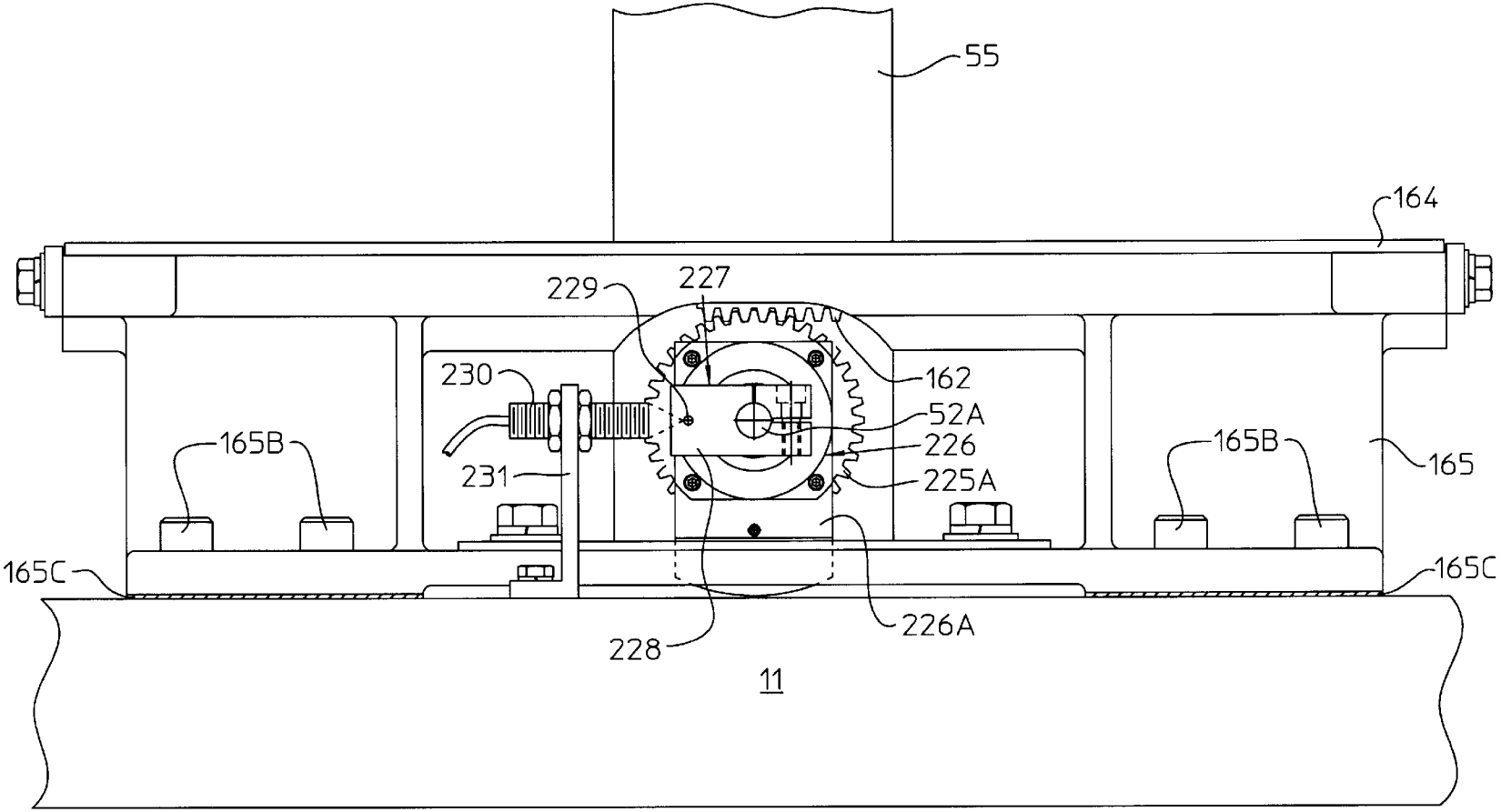
FIG. 20 is a rear elevational view of the bottle rotator drive shown in FIG. 19.
Figure 21:
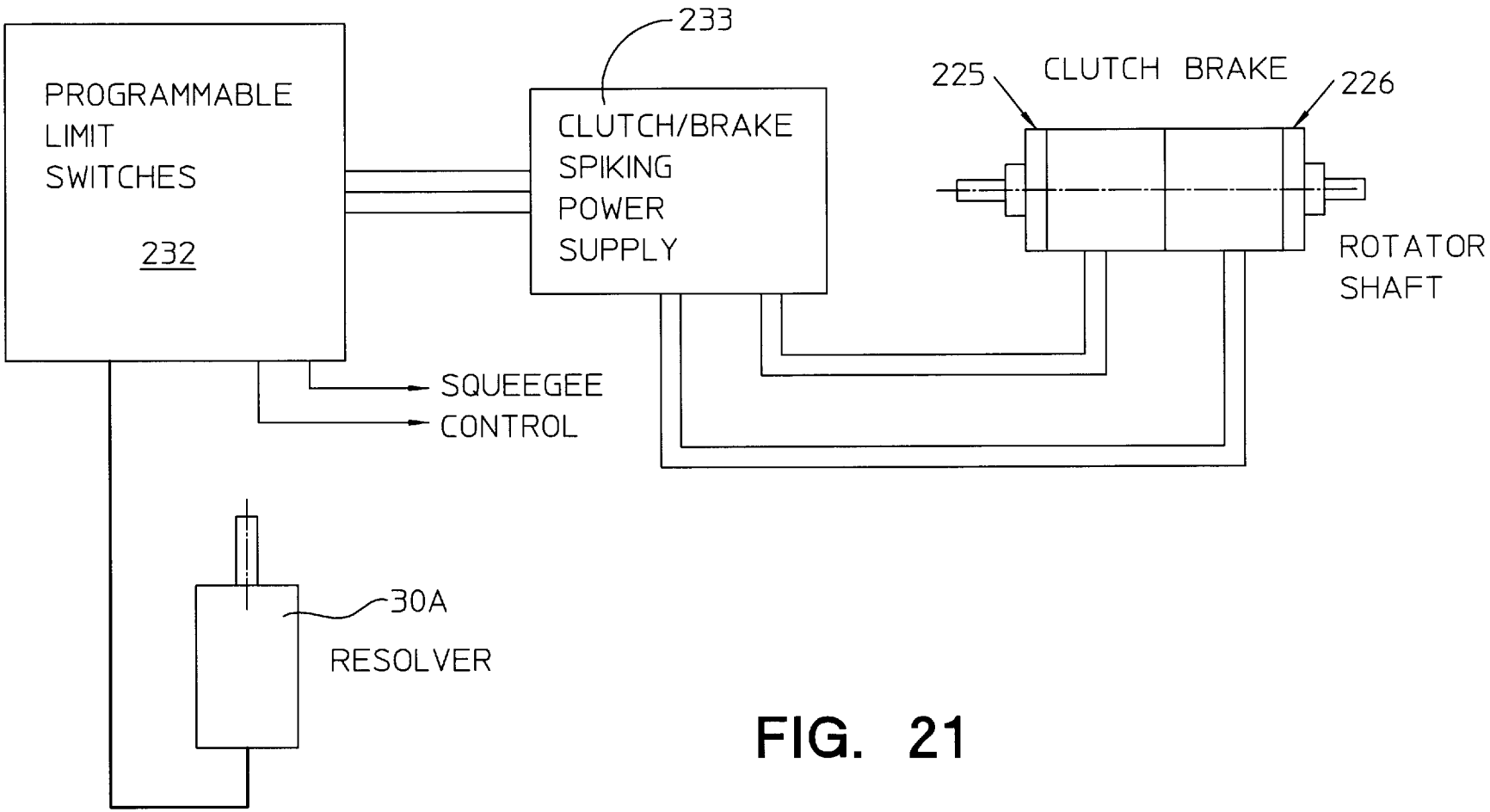
FIG. 21 is a schematic illustration of a control circuit for the bottle rotator drive shown in FIG. 18.
Figure 22:
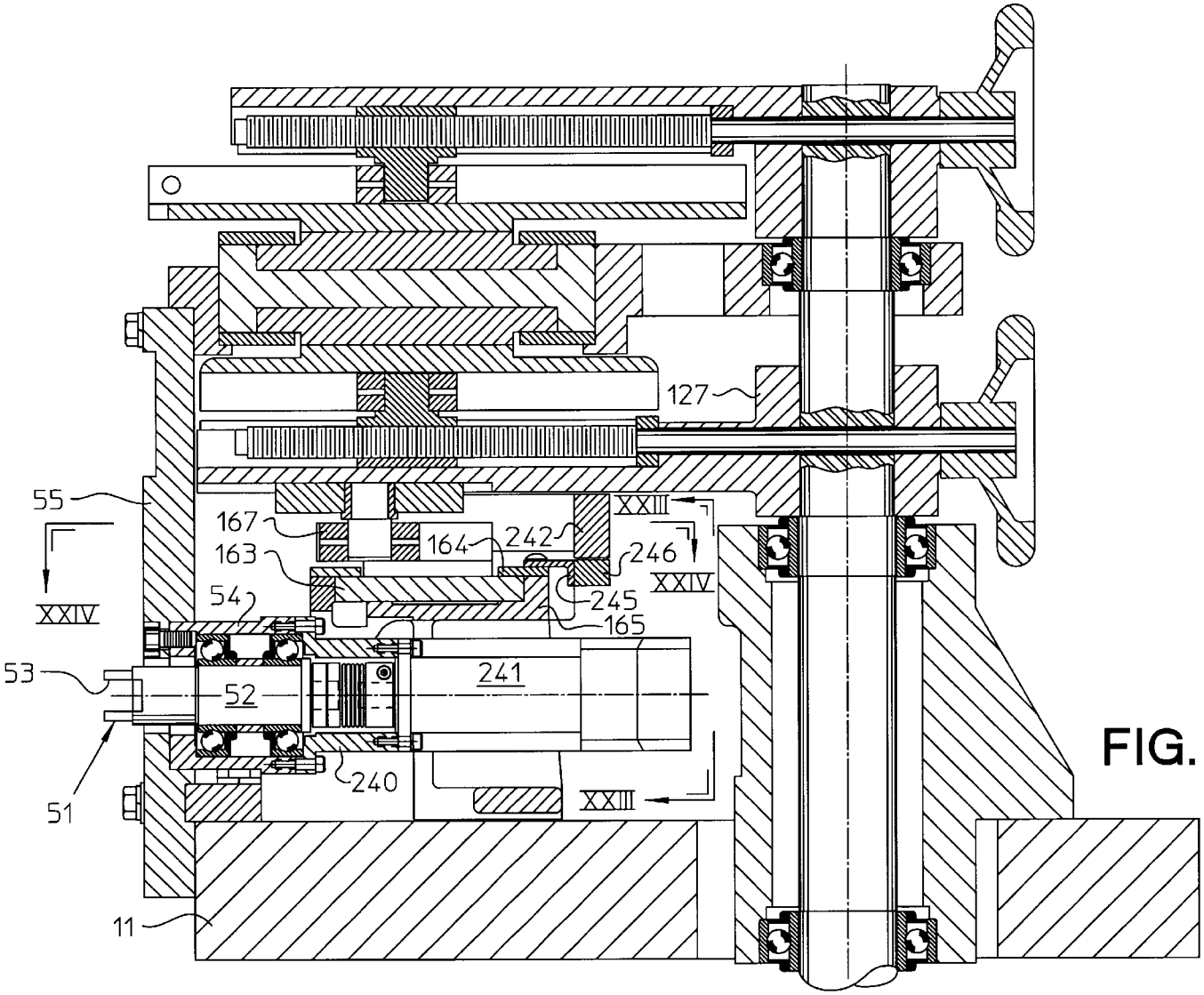
FIG. 22 is a sectional view similar to FIG. 4 and illustrating the preferred embodiment of electronic gearing for rotating a workpiece for high quality decoration.
Figure 23:
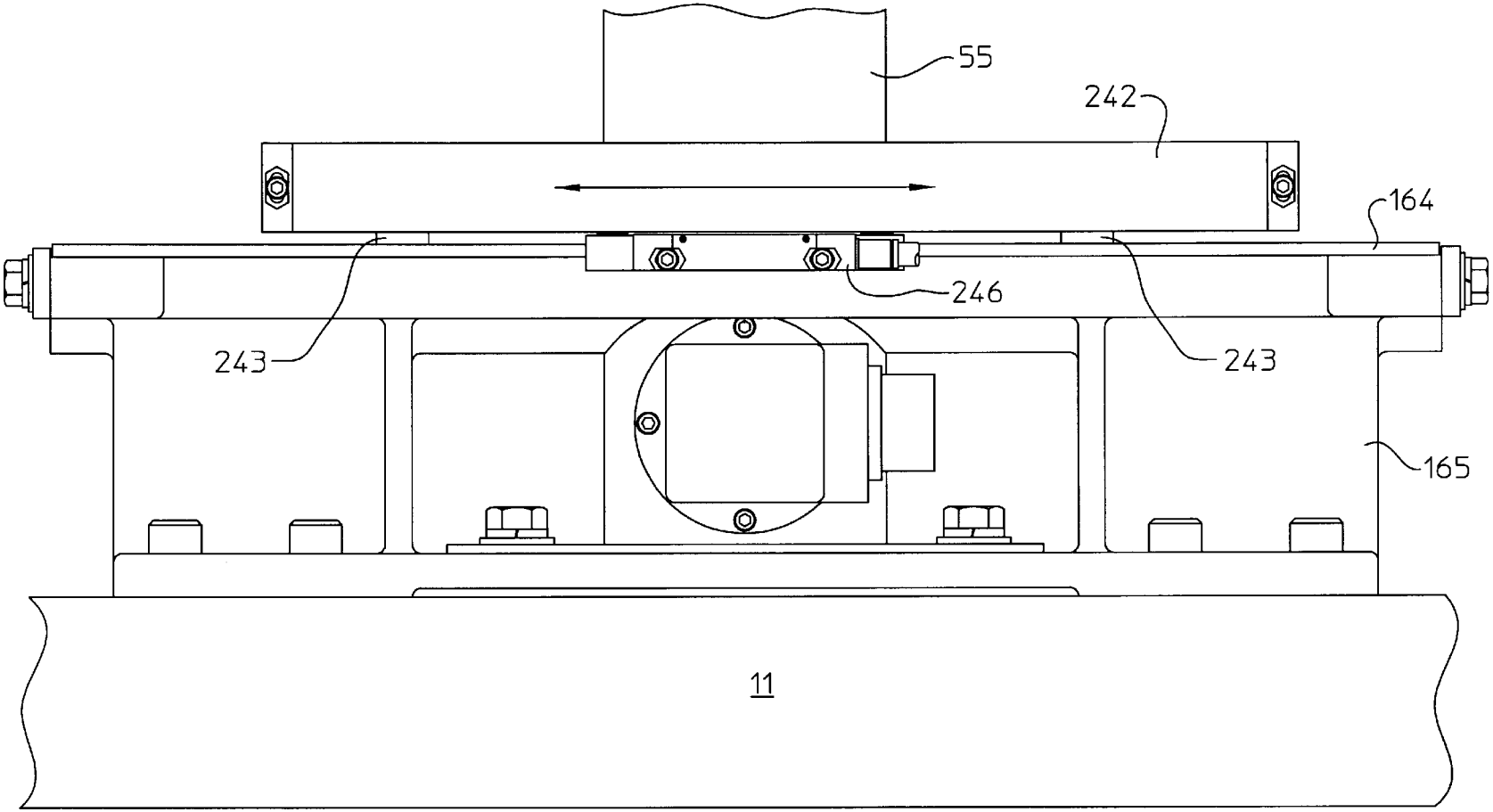
FIG. 23 is an elevational view taken along lines XXIII—XXIII of FIG. 22.
Figure 24:
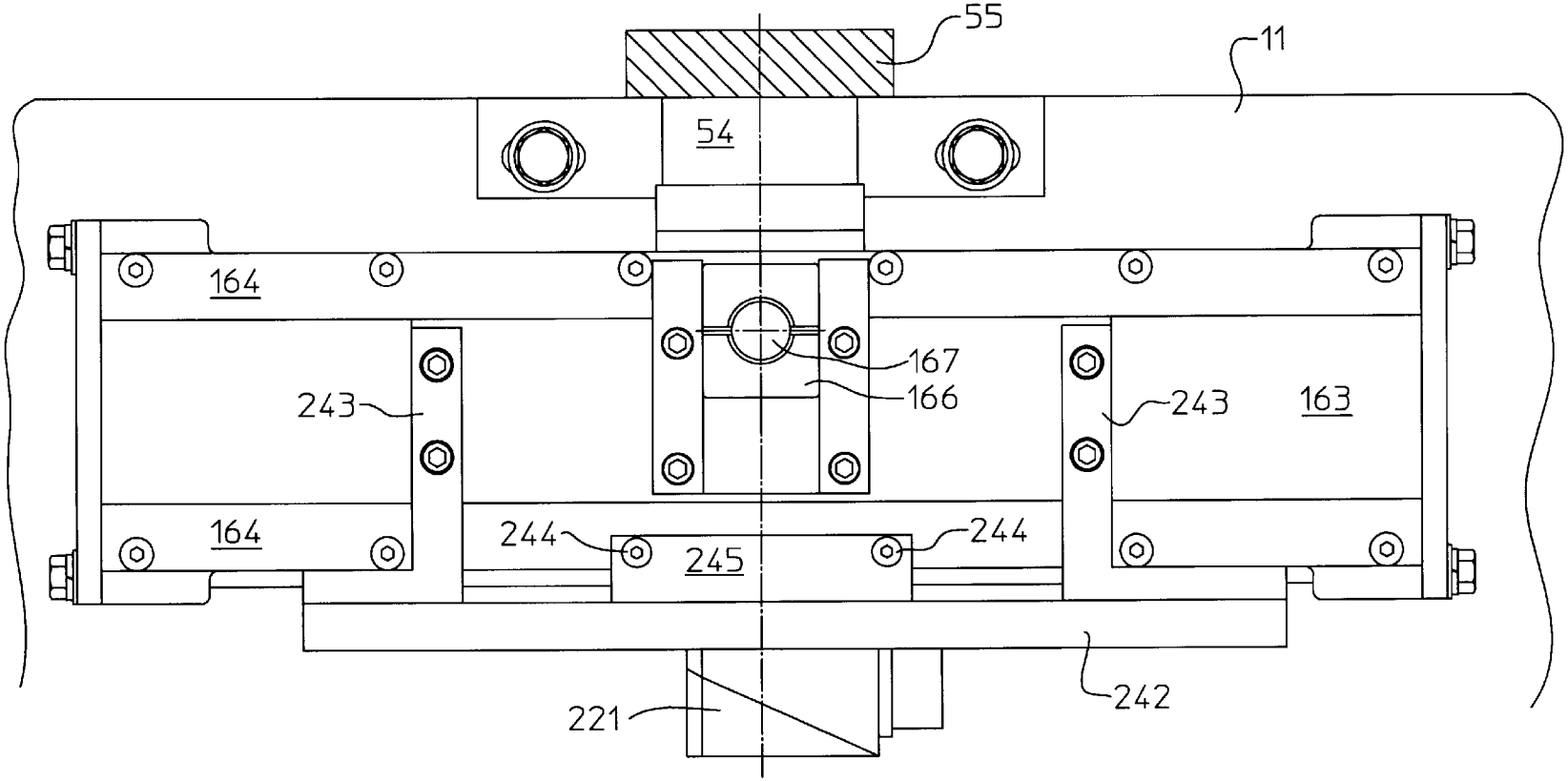
FIG. 24 is a plan view taken along lines XXIV—XXIV of FIG. 22.

For higher speed decoration of a bottle it is preferred to provide a cam track configuration illustrated in FIG. 16 for each cam 67, 68 and 69 to carryout components of a machine cycle illustrated in FIGS. 16 and 17. The machine cycle 215 begins at site $T_0$ with linear travel of the decorating screen in the screen cycle 216 and concurrent rotation of a bottle in a bottle rotation cycle 217 throughout a carrier dwell cycle 218. In this embodiment the screen cycle 216 occupies, for example, 210 degrees of cam rotation during which the bottle carrier remains stationary at the decorating station for the carrier dwell cycle 218 ending at site $T_2$. The remaining 150 degrees of cam rotation in the machine cycle provide a screen return cycle 219 for reciprocating the decorating screen in a reverse to a screen start position at site $T_0$. A carrier index cycle 220 establishes a time period for the removal of a decorated bottle and the supply of an undecorated bottle to the decorating station. A re-home period 221 establish a relatively short period of time to allow a repositioning of the detent ball 56E in response to the biasing force acting on the ball to drive the ball to a seated relation in a V-shaped groove of the clutch control block 56C. The re-home period 221 is necessary only in the event the detent ball fails to seat in the V-shaped groove of the control block at the conclusion of the bottle rotating cycle 207. A bottle dwell period 222 occupies the period between the re-home period 221 and site $T_0$. At higher production speeds, the larger duration of the screen cycle and bottle rotating cycle within the machine cycle advantageously affords a longer period of time to apply decoration to yield high quality decoration.

FIGS. 18–21 illustrate a second embodiment of bottle rotator which includes a tandem arrangement of an electrically actuated clutch 225, an electrically operated brake 226 and a position sensor assembly 227. The clutch 225 includes drive gear 225A mounted on a clutch hub controlled by a drive plate 225B which responds to a stationary coil 225C anchored on one side of a mounting plate 225D. The mounting plate 225D is secured to the pedestal 165. Gear rack 162 is positioned by the use of shims 165C into the desired meshing engagement with the teeth of gear 225A and held in place by bolts 165B. Brake 226 fitted in a cavity provided in pedestal 165 is anchored to the other side of mounting plate 225D. The position sensor assembly 227 is made up of a control block 228 clamped by a fastener bolt to the terminal end portion of arbor 52A and carries a reflective position indicator 229 rotated by the arbor 52A for impingement by a light sensor beam generated by a sensor 230 which also includes a detector to sense the existence of a reflected light beam by the reflective position indicator 229. The sensor 230 is mounted to a bracket 231 secured to the base 11. The resolver 30A driven by the indexer box 30 to provide an electrical signal forming an input to a programmable limit switch 232. The programmable limit switch 232 is programmable to define the bottle rotating cycle and bottle rotator dwell period within the machine cycle. The programmable limit switch provides output control signals applied to a clutch/brake spiking power supply 233 which in turn controllably energizes each of the electric clutch 225 and the electric brake 226 to provide the bottle rotating cycle and bottle dwell cycle for the bottle rotator. Supply 233, per se well known in the art, applies an initial high voltage spike followed by a nominal voltage to produce a substantially instantaneous response by each of the clutch 225 and the brake 226. The control signals occur during the machine cycle such that in a bottle rotating cycle the electric brake is OFF and the electric clutch is ON and in the bottle rotator dwell period the electric brake is ON and the electric clutch is OFF. The electric controls are responsive to discontinue rotation of the rotator after a complete revolution after a decorating cycle so that the rotator is held in this position by the electric brake in a state of readiness to receive a crank arm on a workpiece carrier for the next workpiece introduced to the decorating station.

Figure 25:
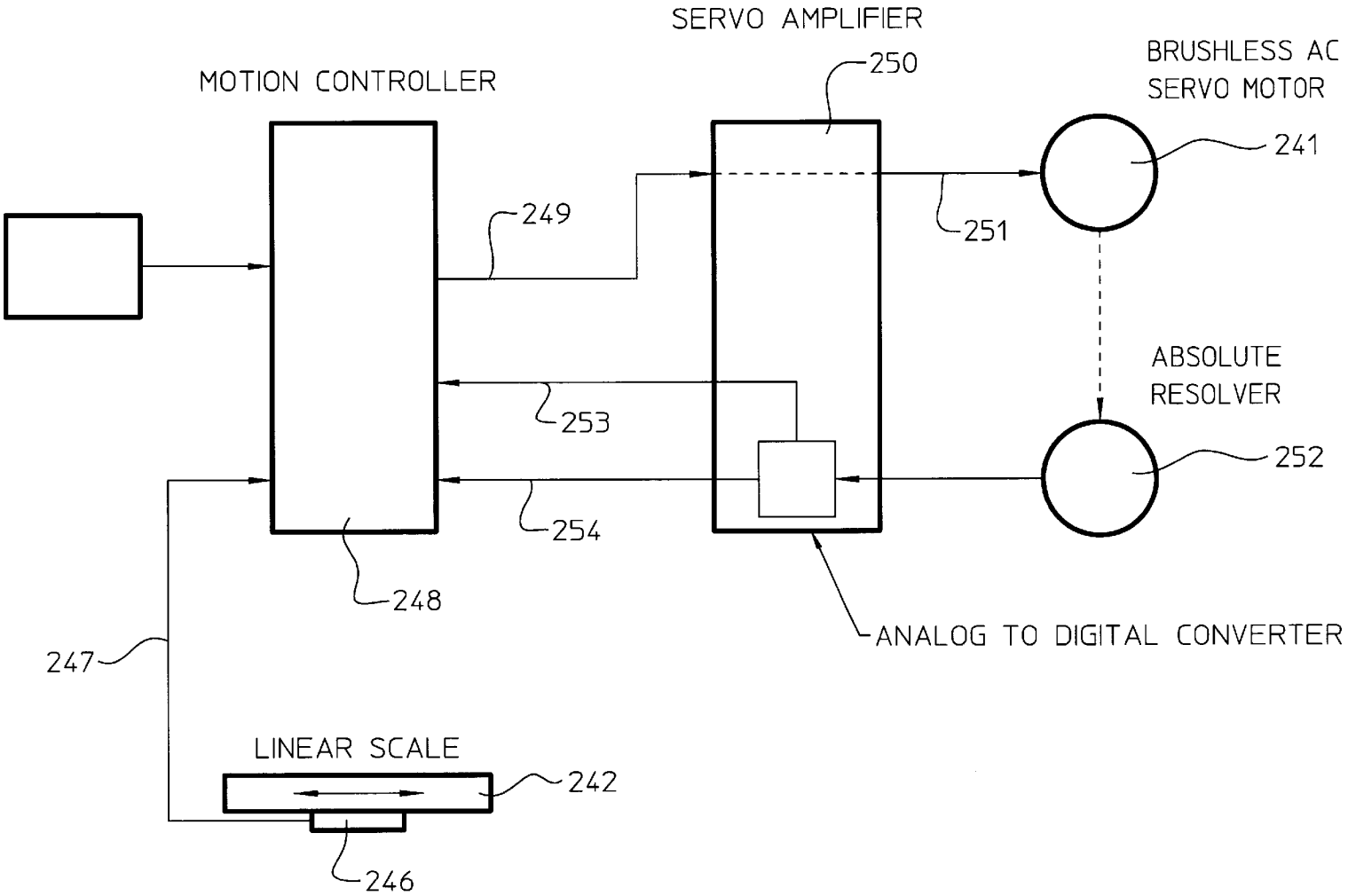
FIG. 25 is a schematic illustration of a control circuit for the electronic gearing shown in FIGS. 22–24.

The operation of the first embodiment of workpiece rotator assembly 51 is improved by the preferred embodiment incorporating electronic gearing shown in FIGS. 22–25 for establishing controlled rotation of the rotator assembly 51 in response to linear displacement of slide 163. A mounting sleeve 240 is affixed by bolts to the bearing housing 54. An electric motor 241 is affixed by bolts to the cantilevered end of the mounting sleeve 240. The preferred embodiment of the present invention embodies a servo motor to form electric motor 241 and for the purpose of disclosing this embodiment of the present invention, a servo motor will be used. Other forms of electric motors responsive to electronic control utilizing, for example, digital control can be employed without departing from the present invention. The servo motor 241 is controlled by a control system shown in FIG. 25 and described hereinafter. The basis for the control of the servo motor is provided by an elongated linear scale 242 mounted at the opposite ends thereof by "L" shaped brackets 243 secured to slide 163 at opposite lateral sides of drive block 166. Fasteners 244 used to attach gib plates 164 to U-shaped channel 165 are provided with an extended length sufficient to secure a standoff bracket 245 for mounting a scanner head 246 to respond to movements of the linear scale 242 and provide an output signal appearing on line 247 to a motion controller 248 as shown in FIG. 25. The motion controller provides a signal appearing on line 249 to a servo amplifier 250 which in turn provides a precisely controlled supply of electrical power applied by line 251 to the servo motor 241.

A feedback loop is formed by a detector 252 such as an encoder or a resolver mounted on and driven by the servo motor 241 to provide an output signal to the servo amplifier 250. The servo amplifier includes a converter for providing two output signals the first of which appears on line 253 as a power startup position input signal to the servo motor controller 248. The power startup position input signal operates when there is a power start up of the decorating machine to establish a known angular position of the drive output shaft of the servo motor 241 corresponding to an angular start position of the rotator assembly 51. The angular start position of the rotator is essential for aligning the slot opening 53 for impact free passage of the drive roller 46 on the crank arm 45 from the guide rails 93 and 94. The second signal delivered from the servo amplifier appears on line 254 for processing by the motor controller 248 to produce a motor control signal applied by line 249 through servo amplifier 250 to the servo motor 241. In the operation of the decorating machine utilizing the electronic gearing described and shown in regard to FIGS. 22–25, the position of the decorating screen at the beginning of screen travel in a machine cycle is detected by the scanner head 246 to accurately maintain a required synchronous speed relation between the displacement of the decorating screen and the rotational speed of the decoration surface of the workpiece. At the end of the decorating cycle, the provision of electronic gearing provides the distinctive advantage for disengaging the workpiece rotator from the screen drive to prevent an unwanted reverse rotation of the workpiece rotator and provide an active drive for connecting the position of the bottle rotator during the re-home cycle occurring between bottle rotating cycle and bottle dwell cycle. The re-home cycle is particularly advantageous when the bottle rotator completes an angular displacement of a bottle greater or less than 360 degrees in a bottle rotating cycle to return the bottle rotator to a start position for driving engagement with a successively delivered bottle to the workpiece rotator. Typically, the rotator will be angularly positioned, if necessary, usually only a degree or less of rotation while at the same time the decorating screen is returned as required by the screen return cycle to a start position for the decoration of a successive bottle carried by the conveyor during the carrier index cycle to the decorating station. This embodiment of the present invention is designed to provide a significant reduction to the tolerance error of plus or minus 1/64 inch in a new decorator and 1/32 inch in a used decorator for color-to-color registration of decoration on a bottle particularly at higher throughput speeds, e.g., 150 bottles per minute.

Figure 26:
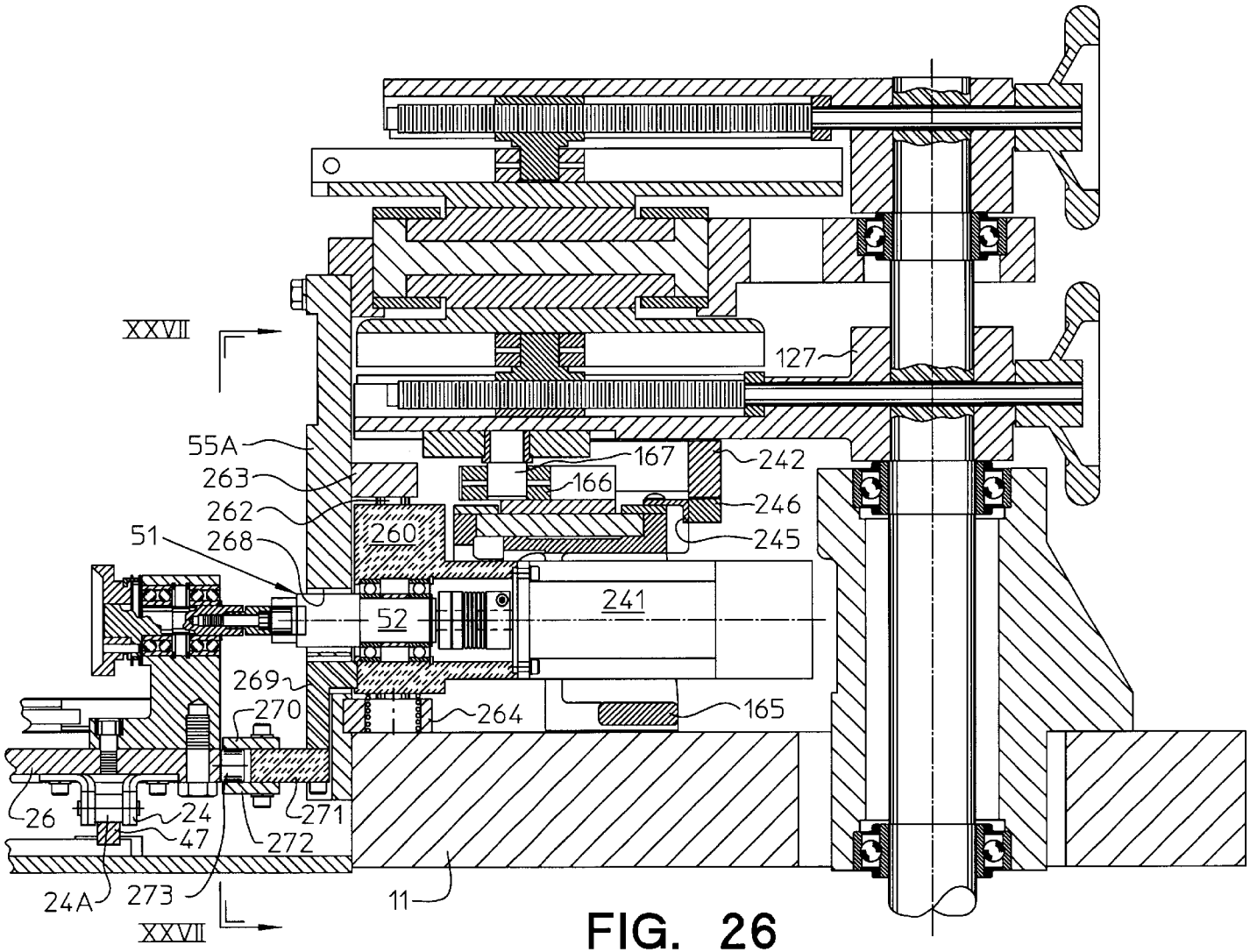
FIG. 26 is an enlarged elevational view in section similar to FIG. 22 and illustrating a modification to the electronic gearing shown in FIGS. 22–24.
Figure 27:
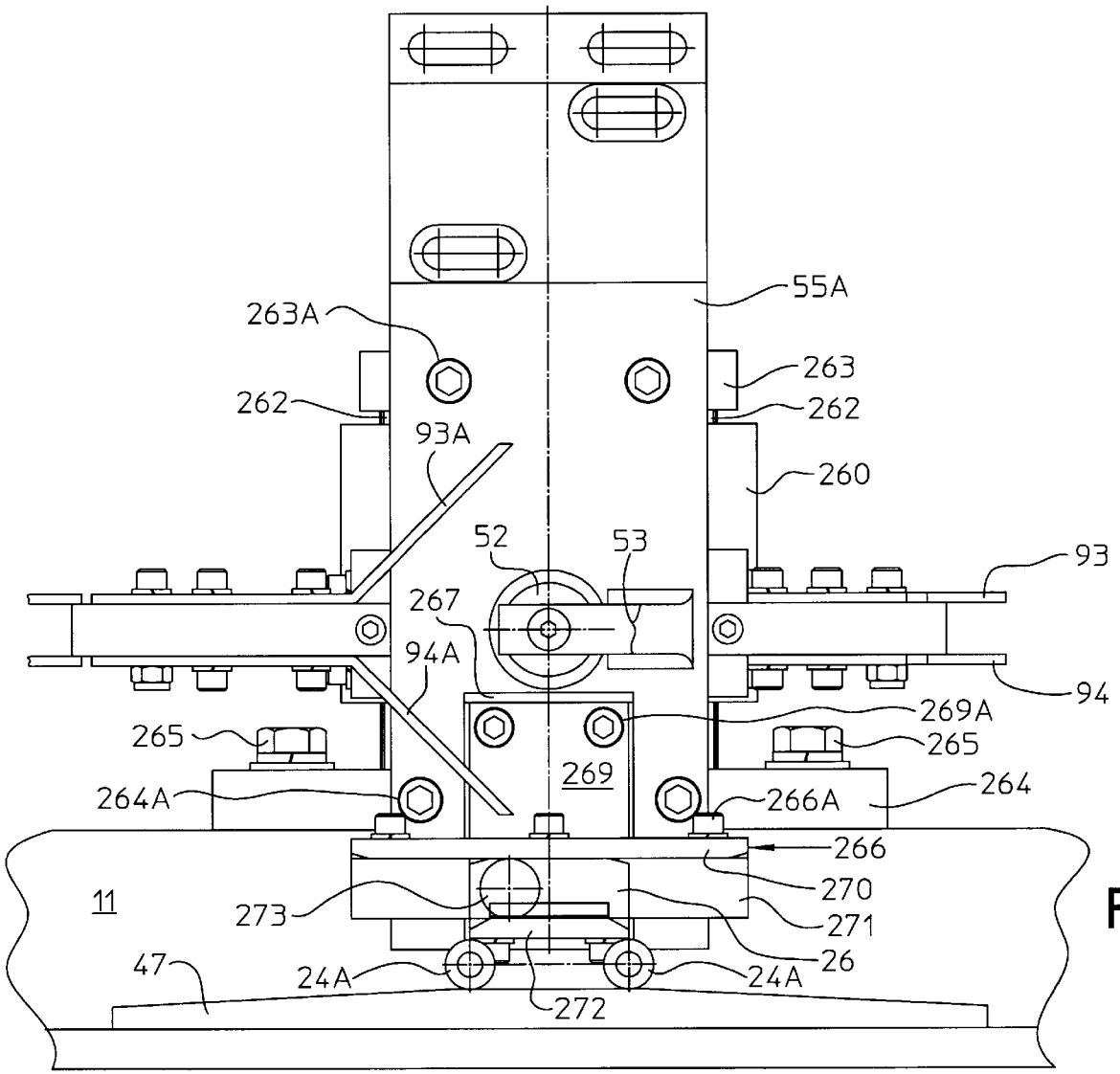
FIG. 27 is an enlarged elevational view taken along lines XXVII—XXVII of FIG. 26.
Figure 28:
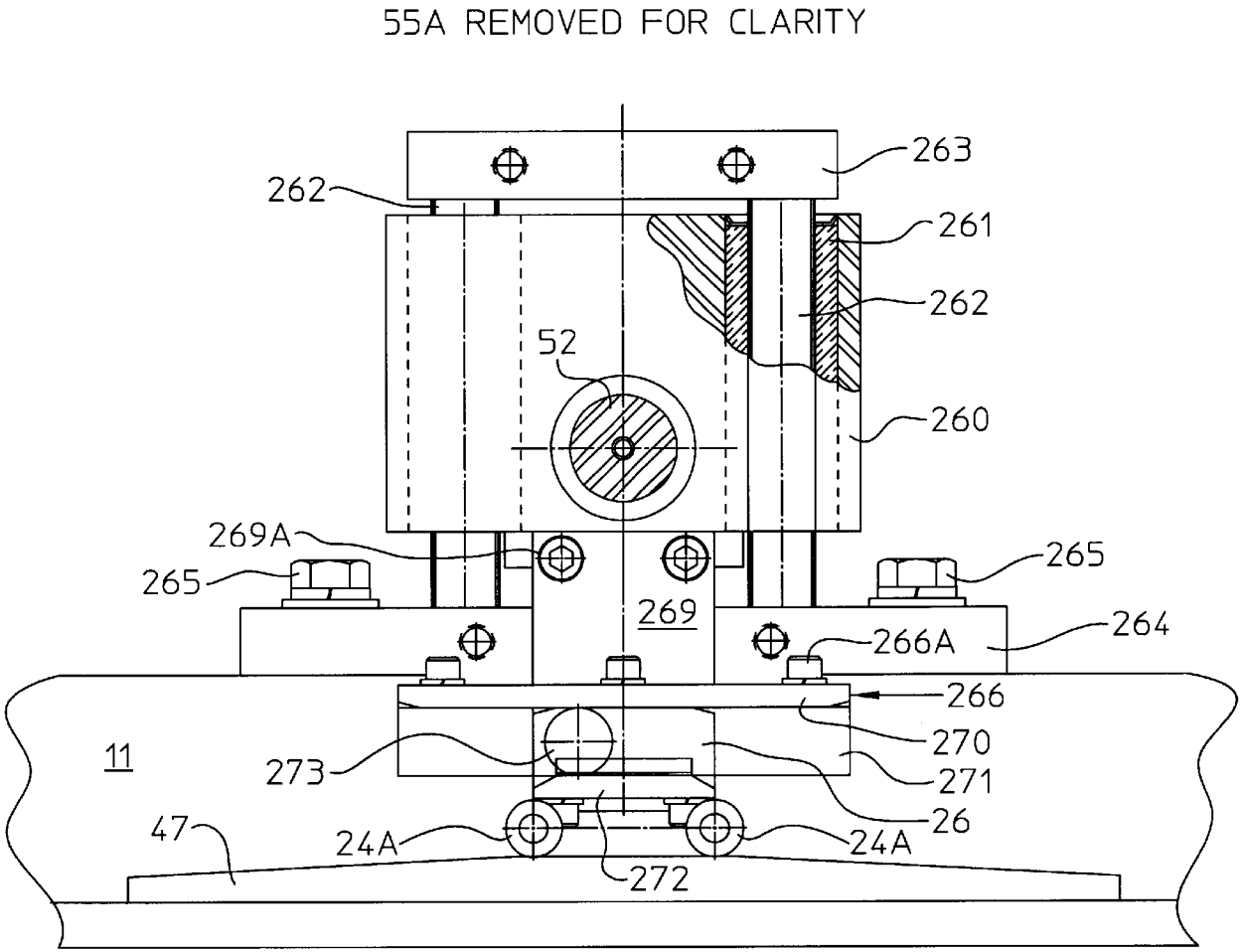
FIG. 28 is a view similar to FIG. 27 with a mounting face plate removed to illustrate the arrangement of parts for vertically positioning the arbor of a workpiece rotator.

A further embodiment of the workpiece rotator is shown in FIGS. 26–28 to provide an elevation control for positioning the workpiece rotator such that the rotational axis thereof is coaxial with the rotational axis of a bottle residing at the decoration station. This embodiment of the workpiece rotator utilizes the benefit obtained through the provision of an electric motor to rotate the workpiece rotator and thereby allow a construction of parts to provide variations to the elevation at which the workpiece rotator is located during the rotation of a bottle for the application of decoration. The coaxial relation between the rotational axis of the rotator and the rotational axis of the bottle on the workpiece carrier eliminates eccentricity appearing as an unwanted speed mismatch error between the decoration surface of the bottle and the screen. The speed mismatch error appears as a distortion of the decoration. The arbor 52 is supported by spaced apart antifriction bearings in a rectangular housing 260 provided with laterally spaced, vertically extending, linear guides 261 that receive spaced apart and upstanding guide rods 262 mounted in a cross head 263 and to a carrier base 264 secured by bolts 265 to the base 11 of the decorating machine. If desired, springs may be positioned between base 264 and housing 260 to establish a nominal elevation for a drive shoe 266 resiliently. The cross head 263 and base 264 are secured by fasteners 263A and 264A to a confronting surface of a face plate 55A provided with a recess 267 including a slot opening below the arbor 52. The face plate 55A is provided with an enlarged aperture 268 to a necessary operating clearance for vertical displacements of arbor 52 when the housing 260 moves vertically along the guide rods 262. Such vertical movement of the housing is controlled in response to vertical movements of the drive shoe 266 by a mechanical interconnection formed by a plate 269 having an "L" shaped cross-sectional shape opening (FIG. 26) to fit in the recess 267. The plate 269 is secured by bolts 269A to the housing 260 and secured to the shoe by bolts 266A.

The drive shoe 266 includes an elongated upper guide plate 270, a vertical side wall 271 and a bottom guide plate 272 that form a slot traversed by a roller member 273 supported to rotate about a horizontal axis by each carrier plate 26 of the workpiece carriers. As a workpiece carrier approaches a workpiece decorating station and a workpiece carrier departs from that workpiece decorating station, the roller members 24A of conveyor links 24 engage with both of the carriers roll along the carrier raiser cams 47 and the rollers 273 of both of the adjacent carriers engage with the downwardly facing surface of upper guide plate 270. The rollers 273 lift, as necessary, the workpiece rotator including the servo motor 241 to the precise elevation necessary so that upon continued advancing movement of the workpiece carrier the rotational axis of the bottle will assume a coaxial relation with the rotational axis of the rotator when the carrier moves the bottle at the desired position for the screen cycle. The extended length of the upper guide plate 270 is preferably chosen such that a roller 273 of a workpiece carrier leaving the decorating station will remain in contact with the upper guide plate while the roller 273 of a workpiece carrier entering the decorating station contacts the upper guide plate. By this arrangement of parts, the guide shoe serves automatically to compensate for wear of roller 24A and wear of associated parts to avoid misalignment between the rotational axis of the bottle rotator and the rotational axis of the bottle; avoids impact loading and other mechanical shock due as workpiece carriers move into and out of each decorating station; and distortion of the applied decoration.

Figure 29:
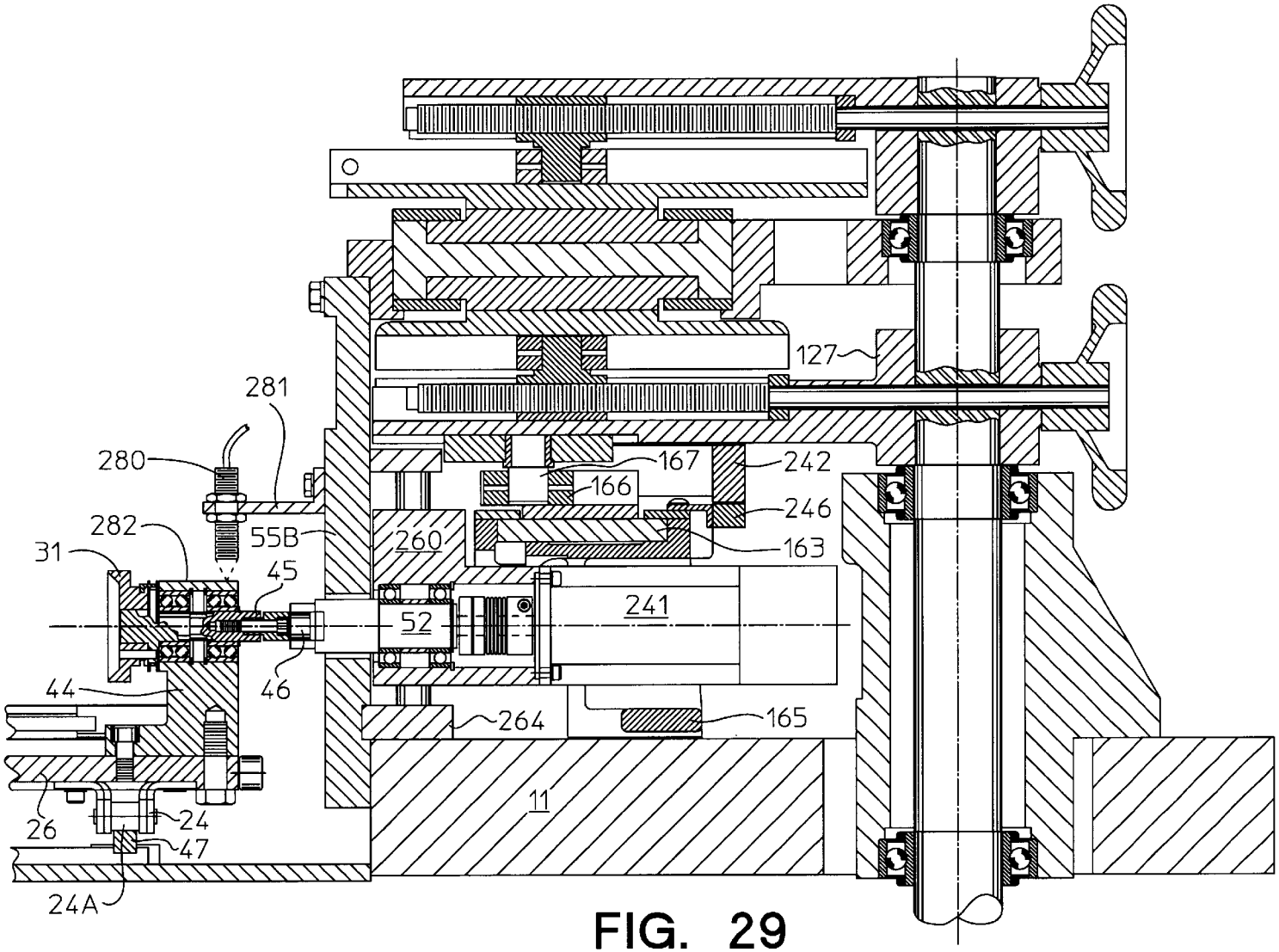
FIG. 29 is an enlarged view similar to FIG. 26 and illustrating a modification to the arrangement of parts for vertically positioning the rotator drive.
Figure 30:
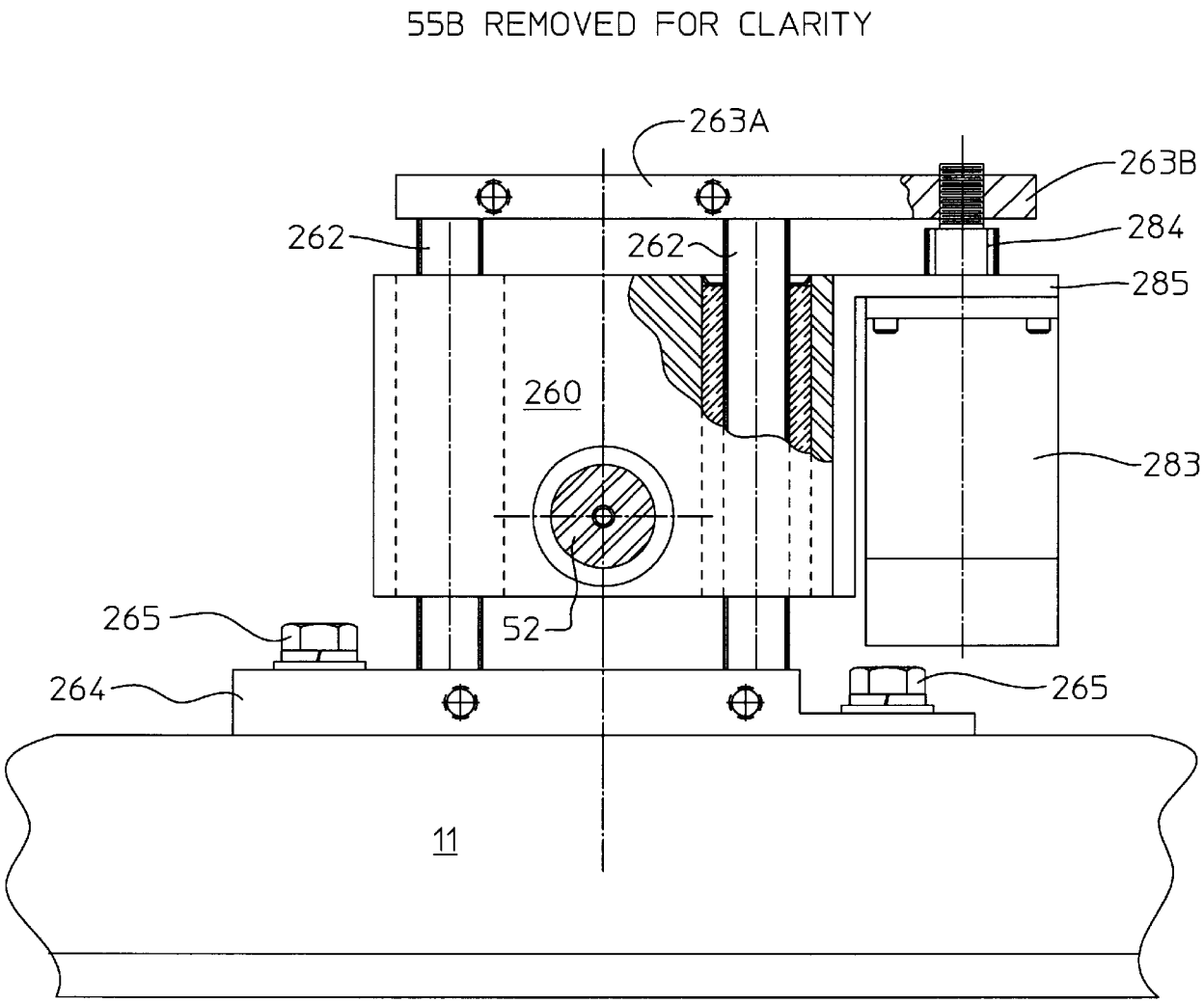
FIG. 30 is a view similar to FIG. 28 and illustrating the modification shown in FIG. 29.

In FIGS. 29 and 30, there is illustrated an electromechanical drive system according to a further embodiment of apparatus for displacing the workpiece rotator to a desired elevation for receiving the drive roller 46 on the crank arm 45 of the workpiece carriers entering each decorating station. In this embodiment the construction of the workpiece rotator including the servo motor 241 is the same as provided in the embodiment of FIGS. 26–28 with the exception that the drive shoe 266 and the plate 269 used to control the elevation of the workpiece rotator have been replaced by an electro mechanical drive system. This drive system includes an optical sensor 280 operatively supported by a bracket 281 secured to a face plate 55B at a site vertically spaced above the path of travel of each upstanding housing 44 used to support the base cup on each carrier of the chain conveyor 12. The optical sensor includes a light beam sender and receiver arranged to provide an electrical output signal corresponding to a measure of the distance between the optical detector and a reference surface 282 formed on each upstanding housing 44. The location of optical sensor 280 is chosen to detect the presence of the reference surface 282 at the decorating station and further chosen so that the impingement site of the optical beam is contained in a vertical plane containing the rotational axis of the workpiece rotator. The electrical output signal of the sensor is used by a conventional processor to derive a control signal representing an error to the elevational difference between the rotational axis of the rotator and the rotational axis of the bottle supported by the workpiece carrier at the decorating station.

The face plate 55B is secured to the carrier base 264 mounted by the fasteners 265A to the base 11. The cross head 263A is secured by fasteners to the face plate 55B and provided with a lateral extension 263B threadedly engaged with an actuator rod 284 of a linear actuator 283. The linear actuator 283 is mounted to a bracket 285 extending from a lateral side of housing 260. When a workpiece carrier arrives at a decorating station, its presence is detected by the optical senor 280 and the control signal representing an error to the elevational difference between the rotational axis of the rotator and the rotational axis of the bottle is used to operate the linear actuator 283 to correct the detected error. Heretofore corrections to the elevation of the rotational axis of a workpiece rotator to accommodate such elevational changes to a workpiece rotator arriving at a decorating station as disclosed in the prior art as discussed hereinbefore and the embodiments herein using a gear rack drive for a one way clutch and an electrically controlled clutch and brake could not be accomplished because of the necessity to maintain a meshing relation between a drive gear and gear rack secured to slide 163.

Figure 31:
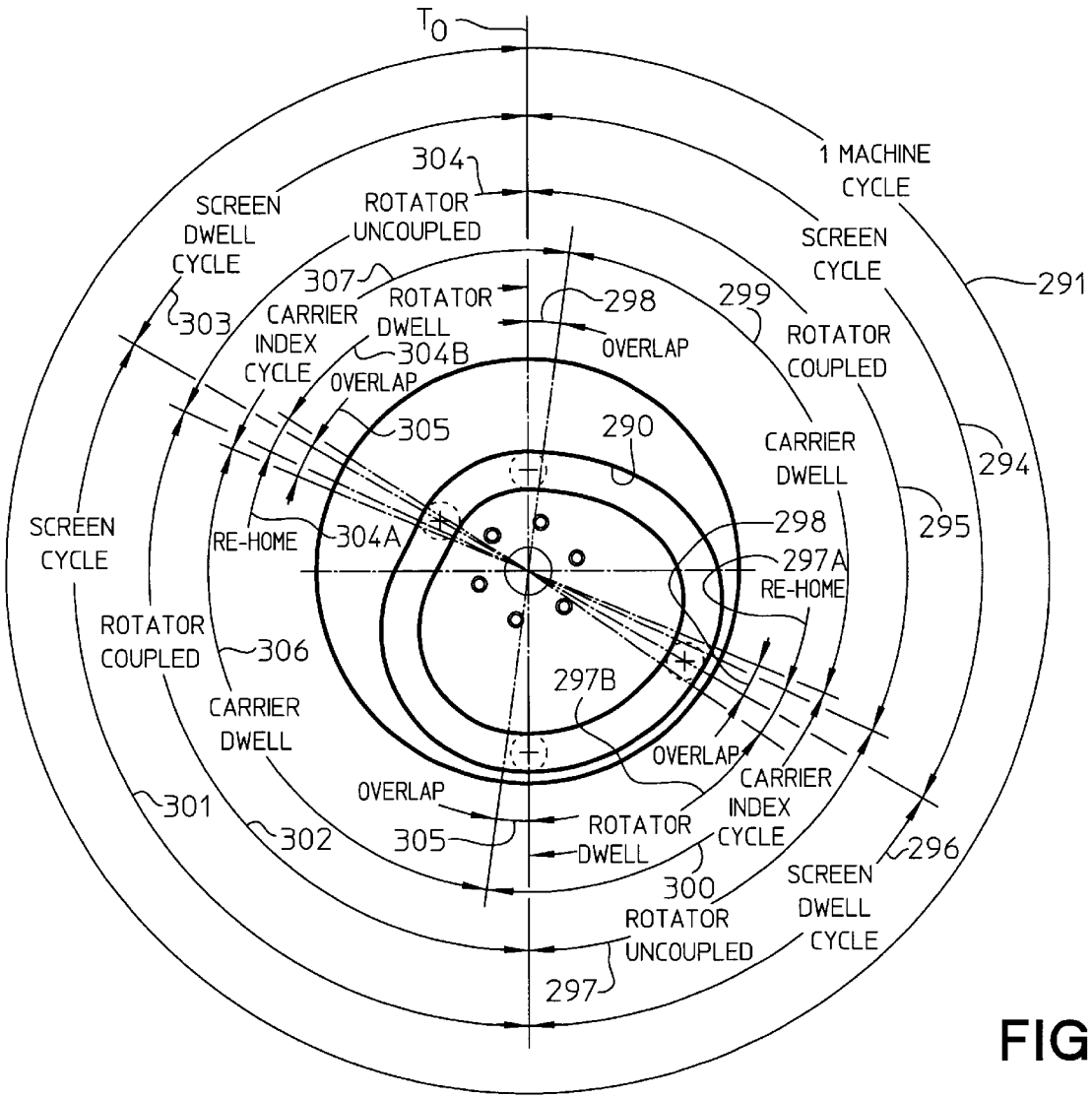
FIG. 31 is a view similar to FIG. 13 showing a modified cam track configuration embodying an overlap of carrier indexing with screen cycles and bottle rotating cycles for providing two decorating cycles in each machine cycle for high quality decoration according to the present invention.
Figure 32:
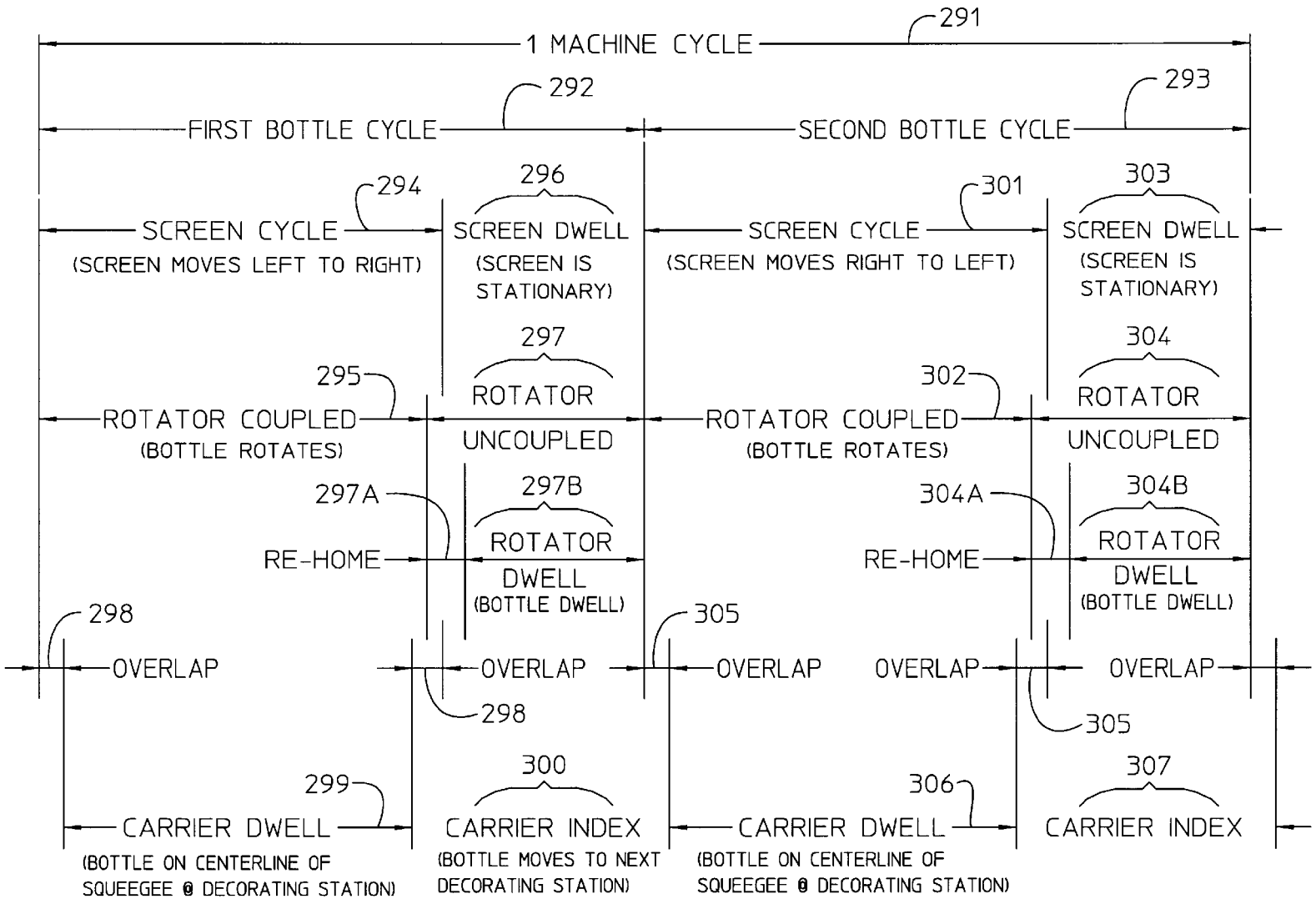
FIG. 32 is a timing sequence diagram showing component cycles of each machine cycle according to the cam track configuration of FIG. 31.

FIGS. 31 and 32 illustrate a further modification to the machine cycle to allow decoration to be applied with extreme accuracy using the servo motor drives of embodiments of FIGS. 22–25 at a high bottle throughput speed, e.g., at speeds of 150 bottles per minute. The machine cycle uses a characteristic of an overlap in components of two bottle cycles occurring in each machine cycle as disclosed in U.S. Pat. No. 5,524,535 and, if desired, without the occurrence of an overlap as disclosed in the embodiment of FIG. 33.

According to the present invention, high speed decorating of bottles at each decorating station is carried out in an identical fashion by initiating screen travel before a bottle completes its final advancing motion by the conveyor driving index box 30 to the decorating station and continuing with a final part of screen travel after movement of the bottle is initiated from the decorating station by the conveyor driving index box. The cam track configuration is shown in FIG. 31 and FIG. 32 illustrates a timing sequence of events comprising the machine cycle beginning at TO defined by the cam track. The cam track 290 establishes, in each machine cycle 291, two bottle decorating cycles 292 and 293. In the first bottle cycle, the decorating screen is linearly displaced in one direction for a screen cycle 294 during which a rotator coupled cycle 295 occurs for the electric motor 241 to rotate a bottle and then shortly before the screen enters a screen dwell cycle 296 the rotator enters a rotator uncoupled cycle 297. The rotator uncoupled cycle 297 is made up of two component parts, namely a re-home cycle 297A and a rotator dwell cycle 297B. The re-home cycle is used when it is necessary to reposition the workpiece rotator from a stop position that is different from a predetermined rotator start position. The rotator dwell cycle 297B is used for maintaining the rotator in a state of readiness for the second bottle cycle 293. The screen cycle 294 and the rotator coupled cycle 295 both have overlaps 298 occurring at the start and finish of a carried dwell cycle 299 provided for maintaining a bottle on a center line of a squeegee at the decorating station. The overlaps 298 are used to increase the bottle decoration rate by allowing the decorating screen and the bottle rotator to commence operation before the bottle carrier stops and to commence advancement of the bottle carrier before completion of the decorating screen cycle 294 and the bottle rotator cycle 295. The overlaps allow more of the machine cycle for a carrier index cycle 300 used for introducing the next bottle to the decorating station. The carrier index cycle continues after the commencement of a screen cycle 301 and a rotator coupled cycle 302 of the second bottle cycle 293.

In the second bottle cycle 293, the decorating screen is linearly displaced in the opposite direction to the direction of screen displacement in the first bottle decorating cycle for a screen cycle 301 during which a rotator coupled cycle 302 occurs for the electric motor 241 to rotate a bottle and then shortly before the screen enters a screen dwell cycle 303, the rotator enters a rotator uncoupled cycle 304. The rotator uncoupled cycle 304 is also made up of two component parts, namely a re-home cycle 304A and a rotator dwell cycle 304B. The re-home cycle is used when it is necessary to reposition the workpiece rotator from a stop position that is different from a predetermined rotator start position. The rotator dwell cycle 304B is used for maintaining the rotator in a state of readiness for the first bottle cycle 292 of the next machine cycle. The screen cycle 301 and the rotator coupled cycle 302 both have overlaps 305 occurring at the start and finish of a carried dwell cycle 306 provided for maintaining a second bottle on a center line of a squeegee at the decorating station. The overlaps 305 are used to increase the bottle decoration rate by allowing the decorating screen and the bottle rotator to commence operation before the bottle carrier stops and to commence advancement of the bottle carrier before completion of the second bottle cycle 293. The overlaps 305 serve the same purpose as overlaps 298 of allowing more of the machine cycle for a carrier index cycle 307 used for introducing the next bottle to the decorating station.

Figure 33:
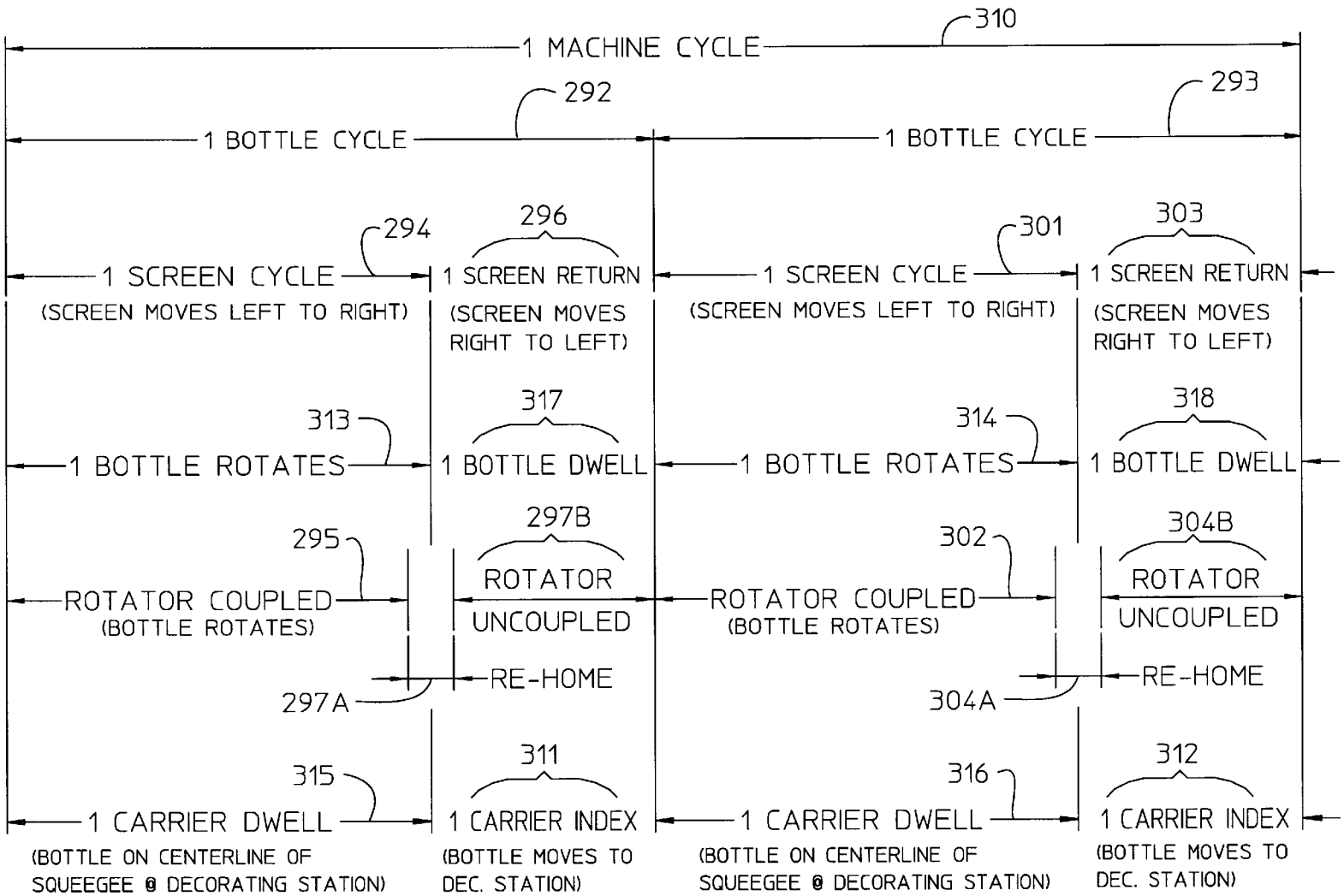
FIG. 33 is a timing sequence diagram for a modified cam track configuration to that shown in FIG. 31 for providing operating component cycles without an overlap between carrier indexing and screen and bottle rotating cycles.

FIG. 33 illustrates a timing sequence of a modified cam track configuration to that shown in FIG. 31 for providing a feature of the operating component cycles of machine cycle 310 occurring without an overlap between carrier indexing cycles 311 and 312 and screen cycles 294 and 301 and bottle rotating cycles 313 and 314, respectively. The carrier dwell cycles 315 and 316 coincide with the screen cycles, respectively. The bottle rotating cycles 313 and 314 are separated by bottle dwell cycles 317 and 318 and provide by the provision of electric motor 241 the rotator coupled cycle 295, re-home cycle 297A, rotator dwell cycle 297B, the rotator coupled cycle 302, re-home cycle 304A, rotator dwell cycle 304B.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. Apparatus for decorating workpieces, said apparatus including the combination of:

a conveyor having a plurality of workpiece supports arranged successively, each workpiece support including a drive arm to rotate a workpiece supported about a longitudinal axis of the workpiece;

at least two decorating stations arranged at spaced apart locations along said conveyor each for applying a decoration to each workpiece, each decorating station including a screen drive operative to linearly reciprocate a decorating screen to provide at least one screen cycle and either a second screen cycle or a screen return cycle for simultaneously decorating resident workpieces at each of said decorating stations, each decorating station further including a squeegee moveable to an operative position to maintaining line contact between said decorating screen and a resident workpiece for applying decoration to a resident workpiece at each of said decorating stations;

a drive arm restraint engaged with each drive arm of the workpiece supports while moved by said conveyor between said decorating stations to maintain an orientation of a workpiece relative to a decoration screen at a first of said decorating station in the same orientation relative to a decorating screen at a second of said decorating stations;

a drive coupled to said conveyor for intermittently advancing workpieces supported by said workpiece supports to said decorating stations, said drive being operative to maintain a workpiece at each of said decorating stations during a dwell period for decorating the resident workpieces at said decorating stations; and each of said first and second decorating stations further including a workpiece rotator to engage with a drive arm of a workpiece support coupled by a drive controller to the screen drive thereof to rotate a decoration receiving surface of a resident workpiece workpieces at both of said first and second decorating stations being rotated by the workpiece rotators thereof with linear travel of both of the decorating screens during said one screen cycle, the drive controller of each of said first and second decorating stations being operable to uncouple the workpiece rotator thereof from the screen drive thereof after said one screen cycle to allow compensation for operating clearances of the workpiece rotator and screen drive of each of said first and second decorating stations and thereby maintain the integrity of said orientation of a workpiece before said second screen cycle or prior to a repeat of said one screen cycle.

2. The apparatus according to claim 1 wherein said screen drive includes a screen reciprocating control for linearly reciprocating said decorating screen in opposite directions to provide a screen cycle during each direction of reciprocation.

3. The apparatus according to claim 1 wherein said workpiece rotator includes an arbor supported for rotation about an axis parallel with the longitudinal axis of a resident workpiece at the decorating station thereof, said drive controller including a one way clutch for rotating said arbor in only one direction of rotation by said screen drive.

4. The apparatus according to claim 3 wherein said workpiece rotator includes a gear rack drivenly coupled to said screen drive to linearly reciprocate along a slidable support on the decorating station thereof, said one way clutch including: a clutch drive gear input including gear teeth meshing with gear teeth of said gear rack; and a clutch drive output member secured to said arbor for rotation thereof in only one direction in response to control by clutch members operative between said clutch drive input and said clutch drive output member.

5. The apparatus according to claim 1 wherein said workpiece rotator includes: an arbor supported for rotation about an axis parallel with the longitudinal axis of a resident workpiece at the decorating station thereof, said drive controller including an electrically actuated clutch and brake anchored to the decorating station thereof; and a control for electrically controlling said clutch and brake to permit rotation of said workpiece rotator only during said one screen cycle and only for one direction of rotation by said arbor.

6. The apparatus according to claim 1 wherein said workpiece rotator includes an arbor supported for rotation about an axis parallel with the longitudinal axis of a resident workpiece at the decorating station thereof, said drive controller including: an electric motor drivingly coupled to said arbor; and an electronic motion detector having a stationary member supported by the decorating station thereof and a moveable member mechanically coupled for response to reciprocating movement of said decorating screen essentially during said one screen cycle for generating a detector signal to electrically control rotation of a workpiece by said electric motor at the decorating station thereof during said one screen cycle.

7. The apparatus according to claim 6 wherein said stationary member is one of a scanner or a linear scale and said electronic motion detector is the other of said scanner or a linear scale.

8. The apparatus according to claim 7 wherein said workpiece rotator further includes: a detector for generating an electrical signal in response to operation of said electric motor; an amplifier receiving said electrical signal for providing a power start up signal and an operational control signal; and a controller receiving each of said detector signal, power start up signal and operational control signal for generating an electric motor control signal to control operation of said electric motor.

9. The apparatus according to claim 7 wherein said electric motor is a servo motor and wherein said amplifier is a servo amplifier and wherein said workpiece rotator further includes: a detector for generating an electrical signal in response to operation of said servo motor; a servo amplifier receiving said electrical signal for providing a power start up signal and an operational control signal; and a controller receiving each of said detector signal, power start up signal and operational control signal for generating a servo motor control signal to control operation of said servo motor.

10. The apparatus according to claim 9 wherein said servo motor control signal is applied to a servo amplifier for control said servo motor.

11. The apparatus according to claim 6 wherein said workpiece rotator includes a bearing housing for rotatably supporting said arbor, guides for controllably restraining said bearing housing to vertical displacement at the decorating station thereof, and a positioner coupled to said bearing housing for controlling the vertical elevation of the rotational axis of said arbor to correspond to the rotational axis of a workpiece residing on said conveyor at the decorating station thereof.

12. The apparatus according to claim 11 wherein said positioner includes a drive shoe supported by said bearing housing, and an actuator roller supported by said conveyor to position said drive shoe and thereby also said arbor at a predetermined elevation at said decorating station.

13. The apparatus according claim 11 wherein said positioner includes a servo motor for vertically positioning said arbor while supported by said bearing housing, and a controller including a distance detector for controlling said servo motor operably connected to adjust the vertical position of said arbor for maintaining a co-axial alignment between a rotational axis of a workpiece at said decorating station and a rotational axis of said arbor.

14. The apparatus according to claim 1 wherein said workpiece supports include spaced apart chucks for supporting a workpiece, and wherein said drive arm includes a crank arm extending to one side of said conveyor from one chuck of each of said workpiece supports for rotating the workpiece supported thereby about a longitudinal axis of the workpiece;

said drive controller including an electronic linear motion detector for generating an electrical signal corresponding to displacement of said decorating screen in each direction of linear reciprocation of said decorating screen, said workpiece rotator including an electric motor controlled in response to said electrical signal for rotating a decoration receiving surface of a resident workpiece at a synchronous speed relation with linear reciprocation of the decorating screen; and wherein said drive arm restraints include vertically spaced guide bars forming a crank arm guide path extending between said at least two decorating stations for receiving and maintaining the orientation of the crank arm extending from each of said workpiece supports advanced by said conveyor from one of said decorating stations to the other of the decorating stations.

15. The apparatus according to claim 14 wherein said electric motor at each decorating station includes an arbor supported for rotation about an axis parallel with the longitudinal axis of a resident workpiece at the decorating station, said electronic control including: an electronic motion detector having a stationary member supported by said intermittent motion decorator and a moveable member mechanically coupled for response to reciprocating movement of said decorating screen essentially during said one screen cycle for generating a detector signal, and a controller responsive to said electrical signal to control rotation of a workpiece by said electric motor.

16. The apparatus according to claim 15 wherein said stationary member is one of a scanner or a linear scale and said electronic motion detector is the other of said scanner or a linear scale.

17. The apparatus according to claim 15 wherein said electronic control includes: a detector for generating an electrical signal in response to operation of said electric motor; an electric amplifier receiving said electrical signal for providing a power start up signal and an operational control signal; and a controller receiving each of said detector signal, power start up signal and operational control signal for generating an electric motor control signal.

18. The apparatus according to claim 15 wherein said electric motor is a servo motor and wherein said amplifier is a servo amplifier and said electronic control includes: a detector for generating an electrical signal in response to operation of said servo motor; a servo amplifier receiving said electrical signal for providing a power start up signal and an operational control signal; and a controller receiving each of said detector signal, power start up signal and operational control signal for generating a servo motor control signal.

19. The apparatus according to claim 18 wherein said servo motor control signal is applied to a servo amplifier for control said servo motor.

20. The apparatus according to claim 14 wherein said workpiece rotator at each of said decorating stations includes an arbor supported by a bearing housing for rotation about a longitudinal axis of said arbor, and a rotator drivenly coupled on said arbor in the path of travel by said crank arm of each of said workpiece supports for receiving and rotating a crank arm of a workpiece while residing at the decorating station.

21. The apparatus according to claim 14 wherein said workpiece rotator further includes a bearing housing for rotatably supporting an arbor drivenly coupled to said electric motor, guides for controllably restraining said bearing housing to vertical displacement at the decorating station thereof, and a positioner coupled to said bearing housing for controlling the vertical elevation of the rotational axis of said arbor to correspond to the rotational axis of a workpiece residing on said conveyor at said decorating station.

22. The apparatus according to claim 21 wherein said positioner includes a drive shoe supported by said bearing housing, and an actuator roller supported by said conveyor to position said drive shoe and thereby also said arbor at a predetermined elevation at said decorating station.

23. The apparatus according claim 21 wherein said positioner includes a servo motor for vertically positioning said arbor while supported by said bearing housing, and a distance detector for controlling said servo motor to adjust the vertical position of said arbor to maintain co-axial alignment between a rotational axis of a workpiece at said decorating station and a rotational axis of said arbor.

24. The apparatus according to claim 1 wherein said screen drive displaces said decorating screen along a linear path of travel in a printing direction for decorating a workpiece and along said linear path of travel in a reverse direction to said printing direction for returning the decorating screen to a position for initiating displacement in said printing direction for decorating a second workpiece;

said workpiece rotator being non responsive to return of the decorating screen in said linear path of travel in a reverse direction.

25. The apparatus according to claim 24 wherein said workpiece rotator includes an arbor supported for rotation about an axis parallel with the longitudinal axis of a resident workpiece at the decorating station thereof, and a one way clutch for rotating said arbor in only one direction of rotation by said screen drive.

26. The apparatus according to claim 25 wherein said workpiece rotator further includes a gear rack drivenly coupled to said screen drive to linearly reciprocate along a slidable support, said one way clutch including: a clutch drive gear input including gear teeth meshing with gear teeth of said gear rack; a stationary clutch member anchored to said intermittent motion decorator to permit rotation of a clutch drive output member in one direction only; and a clutch drive output secured to said arbor for rotation thereof in only one direction in response to control by clutch members operative between said clutch drive input and said clutch drive output member.

27. The apparatus according to claim 24 wherein said workpiece rotator further includes: an arbor supported for rotation about an axis parallel with the longitudinal axis of a resident workpiece at the decorating station thereof, and an electrically actuated clutch and brake; and a control for electrically controlling said clutch and brake to permit rotation of said workpiece rotator only during said one screen cycle and only for one direction of rotation by said arbor.

28. The apparatus according to claim 24 wherein said workpiece rotator further includes: an arbor supported for rotation about an axis parallel with the longitudinal axis of a resident workpiece at the decorating station thereof;

an electric motor drivingly coupled to said arbor; and an electronic motion detector having a stationary member and a moveable member mechanically coupled for response to reciprocating movement of said decorating screen essentially during said one screen cycle for generating a detector signal to electrically control rotation of a workpiece by said electric motor at said decorating station during said one screen cycle.

29. The apparatus according to claim 28 wherein said stationary member is one of a scanner or a linear scale and said electronic motion detector is the other of said scanner or a linear scale.

30. The apparatus according to claim 29 wherein said workpiece rotator further includes: a detector for generating an electrical signal in response to operation of said electric motor; an amplifier receiving said electrical signal for providing a power start up signal and an operational control signal; and a controller receiving each of said detector signal, power start up signal and operational control signal for generating an electric motor control signal to control operation of said electric motor.

31. The apparatus according to claim 29 wherein said electric motor is a servo motor and wherein said amplifier is a servo amplifier and wherein said workpiece rotator further includes: a detector for generating an electrical signal in response to operation of said servo motor; a servo amplifier receiving said electrical signal for providing a power start up signal and an operational control signal; and a controller receiving each of said detector signal, power start up signal and operational control signal for generating a servo motor control signal to control operation of said servo motor.

32. The apparatus according to claim 31 wherein said servo motor control signal is applied to a servo amplifier for control of said servo motor.

33. The apparatus according to claim 28 wherein said workpiece rotator includes a bearing housing for rotatably supporting said arbor, guides for controllably restraining said bearing housing to vertical displacement at the decorating station thereof, and a positioner coupled to said bearing housing for controlling the vertical elevation of the rotational axis of said arbor to correspond to the rotational axis of a workpiece residing on said conveyor at the decorating station thereof.

34. The apparatus according to claim 33 wherein said positioner includes a drive shoe supported by said bearing housing, and an actuator roller supported by said conveyor to position said drive shoe and thereby also said arbor at a predetermined elevation at the decorating station thereof.

35. The apparatus according claim 33 wherein said positioner includes a servo motor for vertically positioning said arbor while supported by said bearing housing, and a controller including a distance detector for controlling said servo motor operably connected to adjust the vertical position of said arbor for maintaining a co-axial alignment between a rotational axis of a workpiece at the decorating station thereof and a rotational axis of said arbor.

36. A method for decorating workpieces, said method including the steps of:

advancing successively arranged workpieces to intermittently reside in succession at each of at least two spaced apart decorating stations, each workpiece being supported for rotation about a longitudinal axis of the workpiece and restrained from rotation while advanced between said decorating stations to maintain an orientation of a workpiece relative to a decoration screen at a first of said decorating station in the same orientation relative to a decorating screen at a second of said decorating stations;

establishing at each decorating station a drivenly coupled relation between a workpiece rotator and a screen drive to form a synchronous speed relation between linear displacement of a decorating screen in a first direction from a screen start position between a squeegee and a decoration surface of a workpiece at each of said decorating stations during rotation of the workpiece in one screen cycle by a workpiece rotator from a rotator start position;

commencing the application of a decoration by the decorating screen to the decoration surface of the workpieces at each of said decorating stations while maintaining said synchronous speed relation;

concluding the application of decoration on the workpieces at each of said decorating stations with the decorating screen displaced distant to said screen start position and the workpiece rotator is rotated to, at least proximate, said rotator start position of the workpiece rotator;

discontinuing said drivenly coupled relation between the workpiece rotator and the screen drive to allow compensation for operating clearances of the workpiece rotator and the screen drive of each of said decorating stations;

linearly displacing the decorating screen in a second direction opposite to said first direction for either a second screen cycle or screen return cycle and thereby displace said decorating screen to said screen start position; and establishing said synchronous speed relation between said decorating screen and a decoration surface of the next ones of the successively arranged workpieces for the application of decoration at each of said decorating stations.

37. The method according to claim 36 wherein said step of establishing includes generating an electrical signal corresponding to linear displacement of said decorating screen and using said electrical signal to control a motor for driving said workpiece rotator.

38. The method according to claim 37 including the further step of generating a startup control signal corresponding to a power startup position of said workpiece rotator, using said startup control signal to control said motor for driving said workpiece rotator to a startup location for initiating said one screen cycle.

39. The method according to claim 36 including the further step of adjusting the vertical elevation of a rotational axis of said workpiece rotator to correspond to a rotational axis about which workpieces rotate at said decorating stations.

40. The method according to claim 39 wherein said step of adjusting the vertical elevation includes generating an electrical signal corresponding to the rotational axis about which workpieces rotate at said decorating stations to control an actuator for adjusting said vertical elevation of a rotational axis of said workpiece rotator.

41. The method according to claim 36 including the further step of driving said workpiece rotator independently of linear screen displacement for said adjusting the position of the workpiece rotator for restarting said synchronous speed relation.

42. The method according to claim 36 including the further step of registering said first workpiece to establish a desired orientation for decoration at said decorating station, said registration comprising rotating the workpiece about a longitudinal axis of the workpiece at a registration station, using registration indicia on the workpiece to stop rotation of the workpiece at the registration station, and allowing the workpiece to remain non-rotatably orientated while indexing the orientated workpiece to a first of said decorating stations.

43. The method according to claim 36 wherein said step of linearly displacing the decorating screen in a second direction includes passing decorating screen drive elements through operating clearances during reversal of linear screen displacement for returning said decorating screen in a direction opposite of said first direction and adjusting the position of the workpiece rotator for restarting said synchronous relation to decorate a second workpiece.

44. The method according to claim 43 wherein said step of establishing said synchronous speed relation includes reestablishing a driving coupling relation between the workpiece rotator and said screen drive to maintain a synchronous speed relation with the peripheral speed of a second workpiece and the displacement of the decorating screen in said second direction to decorate the second workpiece.

45. The method according to claim 36 wherein said step of linearly displacing the decorating screen in a second direction comprises returning said decorating screen in said screen return cycle.

46. The method according to claim 45 wherein said step of discontinuing includes correcting for position error between the rotated position of said workpiece rotator and a start position for a successive screen cycle.

47. The method according to claim 45 wherein said drivenly coupled relation includes generating an electrical signal corresponding to linear displacement of said decorating screen and using said electrical signal to control a motor for driving said workpiece rotator.

48. The method according to claim 45 including the further step of generating a startup control signal corresponding to a power startup position of said workpiece rotator, using said startup control signal to control said motor for driving said workpiece rotator to a startup location for initiating said one screen cycle.

49. The method according to claim 45 including the further step of adjusting the vertical elevation of a rotational axis of said workpiece rotator to correspond to a rotational axis about which said first workpiece rotates.

50. The method according to claim 49 wherein said step of adjusting the vertical elevation includes generating an electrical signal corresponding to the rotational axis about which said first workpiece rotates to control an actuator for adjusting said vertical elevation of a rotational axis of said workpiece rotator.

51. The method according to claim 45 including the further step of driving said workpiece rotator independently of linear screen displacement for said adjusting the position of the workpiece rotator for restarting said synchronous relation.

52. The method according to claim 45 including the further step of registering said first workpiece to establish a desired orientation for decoration at said decorating station, said registration comprising rotating the workpiece about a longitudinal axis of the workpiece before entry in a registration station, advancing said first workpiece to the registration station, using registration indicia on the workpiece to stop rotation of the workpiece at the registration station, and allowing the workpiece to remain non-rotatably orientated while indexing the orientated workpiece to the decorating station thereof.

53. A method for decorating of workpieces, said method including the steps of:

intermittently advancing spaced apart workpieces along a course of travel containing at least two spaced apart decorating stations;

using workpiece crank arms each drivenly engaged with one workpiece to maintain a workpiece registration along said course of travel between each workpiece and a decorating screen at each decorating station; and decorating each workpiece at each decoration station by:

a) applying decoration to a first workpiece during a first of two decorating cycles within a machine cycle, the first decorating cycle including linearly displacing a decorating screen along a path of travel in one direction between a squeegee and said first workpiece residing at the decorating station;

b) producing an electrical signal corresponding to linear displacement of said decorating screen along said path of travel at the decorating station;

c) controlling an electric motor having a workpiece rotator mechanically engaged with an associated crank arm to rotate said first workpiece about an axis lying in a first plane containing said squeegee in response to said electrical signal to maintain a synchronous speed relation between the peripheral speed of a decoration surface of said first workpiece and the linear speed of said decorating screen;

d) drawing a printing medium from the decorating screen onto the annular surface of said first workpiece along the line of contact formed by said squeegee;

e) interrupting the response by said electric motor to said electrical signal to allow compensation for operating clearances of the workpiece rotator and the screen drive of each of said decorating stations and to positioning a second workpiece at each of said decoration stations;

f) applying decoration to said second workpiece during the second of two decorating cycles within a machine cycle, the second decorating cycle including linearly displacing a decorating screen along said path of opposite linear travel between a squeegee and said second workpiece residing at the decorating station;

g) producing an electrical signal corresponding to linear displacement of said decorating screen along said path of opposite linear travel at the decorating station;

h) controlling said electric motor having the workpiece rotator mechanically engaged with an associated crank arm to rotate said second workpiece about an axis lying in a first plane containing said squeegee in response to said electrical signal to maintain a synchronous speed relation between the peripheral speed of a decoration surface of said second workpiece and the linear speed of said decorating screen; and i) drawing a printing medium from the decorating screen onto the annular surface of said second workpiece along the line of contact formed by said squeegee for applying decoration to said second workpiece during a second decorating cycle within said machine cycle.

54. The method according to claim 53 including the further step of adjusting the position of the workpiece rotator to correct for position error between the rotated position of said workpiece rotator after decoration of said first workpiece to a start position for rotating a second workpiece by said workpiece rotator for decoration thereof.

55. The method according to claim 54 including the further steps of:

initiating removal of said first workpiece from the first plane at the decoration station before stopping the linear displacement of the decorating screen;

causing the decorating screen to remain stationary in a screen dwell cycle after said step of initiating removal of said first workpiece; and initiating linear displacement of said decorating screen after said step of adjusting the position of the workpiece rotator along a path of opposite linear travel to said one direction and concurrently rotating said workpiece rotator by said electrical motor controlled in response to an electrical signal corresponding to such opposite linear travel of said decorating screen.

56. The method according to claim 53 wherein said electrical motor comprises a servo motor for driving said workpiece rotator.

57. The method according to claim 56 including the further step of generating a startup control signal corresponding to a power startup position of said workpiece rotator, using said startup control signal to control said servo motor for driving said workpiece rotator to a start position for initiating said first decorating cycle.

58. The method according to claim 53 including the further step of adjusting the vertical elevation of a rotational axis of said workpiece rotator to correspond to a rotational axis about which said first workpiece rotates.

59. The method according to claim 58 wherein said step of adjusting the vertical elevation includes generating an electrical signal corresponding to the rotational axis about which said first workpiece rotates to control an actuator for adjusting said vertical elevation of a rotational axis of said workpiece rotator.

60. The method according to claim 53 including the further step of driving said workpiece rotator for independently of linear screen displacement for said adjusting the position of the workpiece rotator for restarting said synchronous relation.

61. The method according to claim 53 including the further step of registering said first workpiece to establish a desired orientation for decoration at said decorating station, said registration comprising rotating the workpiece about a longitudinal axis of the workpiece before entry in a registration station, advancing said first workpiece to the registration station, using registration indicia on the workpiece to stop rotation of the workpiece at the registration station, and allowing the workpiece to remain non-rotatably orientated while indexing the orientated workpiece to said first plane.

* * * * *